United States Patent [19]

Goodwin

[11] 4,095,305

[45] Jun. 20, 1978

[54] CLEANING APPARATUS FOR TUBES AND TUBE BUNDLES

[75] Inventor: Robert J. Goodwin, Hendersonville, N.C.

[73] Assignee: C. H. Heist Corporation, Clearwater, Fla.

[21] Appl. No.: 704,474

[22] Filed: Jul. 12, 1976

Related U.S. Application Data

[63] Continuation-in-part of Ser. No. 627,556, Oct. 31, 1975, abandoned.

[51] Int. Cl.[2] ..... F28G 3/10

[52] U.S. Cl. ..... 15/104.1 R; 134/167 C; 408/129

[58] Field of Search ..... 15/104.1 R, 104.1 C, 15/104.3 R, 104.3 SN; 134/167 C, 168 C; 408/103, 104, 129, 130, 135, 137

[56] References Cited

U.S. PATENT DOCUMENTS

| | | | |
|---|---|---|---|
| 632,532 | 9/1899 | Markwort | 15/104.1 R |
| 690,878 | 1/1902 | Roan | 15/104.1 R |
| 698,193 | 4/1902 | Forsyth et al. | 15/104.1 R |
| 782,897 | 2/1905 | Casaday | 15/104.1 R |
| 2,237,880 | 4/1941 | Von Bon Horst et al. | 15/104.3 SN |
| 3,176,335 | 4/1965 | Ciaccio et al. | 15/104.3 SN |
| 3,354,490 | 11/1967 | Masters et al. | 15/104.1 R |
| 3,399,415 | 9/1968 | Hammond et al. | 15/104.3 SN |
| 3,400,419 | 9/1968 | Fuller | 15/104.1 R |
| 3,448,477 | 6/1969 | Ricordeau et al. | 15/104.1 R |
| 3,817,262 | 6/1974 | Caradeur | 134/167 C |
| 3,903,912 | 9/1975 | Ice, Jr. et al. | 134/167 C |

*Primary Examiner*—Edward L. Roberts
*Attorney, Agent, or Firm*—Joseph P. Gastel

[57] ABSTRACT

(1) A construction for reciprocating and rotating a lance comprising a frame, attachment structure for securing said frame relative to a tube to be cleaned, lance reciprocating and rotating mechanism on said frame substantially adjacent said tube, a carriage for attachment to the end of the lance remote from said tube, a swivel connection on the carriage for permitting rotation of the lance while high pressure water is being fed thereto, a carriage support for supporting said carriage for movement toward and away from said tube, and a mounting arrangement for mounting said carriage support. (2) A frame for mounting a lance advancing mechanism including first and second spaced frame members, clamp members for attaching the first and second frame members to the end plate of a tube bundle, track members extending between the first and second frame members, a carriage for mounting a lance advancing mechanism mounted on the track members, an adjustment arrangement for varying the position of the track members relative to the end plate, and indexing members for varying the position of the carriage on the track members.

30 Claims, 34 Drawing Figures

17
164
165
166
167
16
150
18
4
4
15
151
153
155
3
3
14
160
161
162
157
158
154

12
12'
13
19
23
24
25
26
27
28
29
30
31
32
32'
33
34
35
36
37
38
39
40
41
42
43
44
45
46
47
48
49
50
51
6
6

269
280
270
21
278
274
245
205
270
258
250
246

269
21
280
275
273
276
270
205
274
273'
277
273'
274
273
272

283
282
289
290
288
284
291
293
285
287
292
286
229
235
210
236
33
238
233
231
238
234
33
209

236
234
203
231
210
238
237

CLEANING APPARATUS FOR TUBES AND TUBE BUNDLES

The present application is a continuation-in-part of the copending application of Robert J. Goodwin, Ser. No. 627,556, filed Oct. 31, 1975 and now abandoned.

The present invention relates to improved apparatus for axially reciprocating and rotating a tube cleaning lance.

By way of background, there are in existence devices for advancing tube cleaning lances into a tube which is to be cleaned. However, these devices are subject to certain shortcomings. In this respect, certain types of apparatus drive a lance, which may be between 20 and 40 feet long, from the end remote from the tube. This requires intermediate support structure to prevent the lance from bending or whipping. This condition also severely limits the amount of axial force which can be applied to the tip through the lance or, conversely, accepted by the lance as a reactive force from the tip. Furthermore, to applicant's knowledge there is no known structure for driving a tube cleaning lance both in an axial and rotary direction from a location immediately adjacent the tube to be cleaned, thereby providing the combined advantages of rotating a lance and advancing it axially into a tube without having a long expanse of unsupported lance which can buckle or bend. Furthermore, certain prior art lance advancing mechanisms were extremely complicated and difficult to install for the short length of time required to clean a tube bundle or the like. It is with overcoming the foregoing deficiencies of the prior art that the present invention is concerned. Representative prior art patents include U.S. Pat. Nos. 3,269,659, 3,389,713, 3,421,939, 3,536,263, 3,377,026, 3,736,909, 3,794,051 and 3,817,262.

It is one important object of the present invention to provide an improved apparatus for axially reciprocating and rotating a tube cleaning lance so as to effect the tube cleaning in a highly efficient manner.

Another object of the present invention is to provide an improved lance reciprocating and rotating apparatus for a tube-cleaning lance which is located immediately adjacent the tube to be cleaned to thereby obviate buckling of the lance between the apparatus and the tube.

An additional object of the present invention is to provide an improved lance reciprocating and rotating apparatus for a tube cleaning lance which, due to the position of the device immediately adjacent to the tube sheet, permits tips to be utilized that require for proper operation high torque and/or high thrust, either of which is sufficient to buckle a lance so loaded but not continuously constrained along its length.

Yet another object of the present invention is to provide improved apparatus for axially reciprocating and rotating a tube cleaning lance which permits the rates of axial movement and rotation of the lance to be independently varied, as required for optimum results.

Yet another object of the present invention is to provide improved lance reciprocating and rotating apparatus which can be indexed simply and easily relative to a tube bundle or other equipment which is being cleaned.

A further object of the present invention is to provide improved apparatus for rotating and axially reciprocating a tube cleaning lance in which the end of the lance remote from the tube being cleaned is supported in a manner which permits easy and rapid horizontal and vertical adjustment as required for rapid tube cleaning.

A still further object of the present invention is to provide improved axially reciprocating and rotating capability for a lance in an apparatus which can be moved and assembled easily and quickly even in relatively inacccessible locations because the apparatus is light and is constructed of unitized components which are readily assembled and adjusted to the equipment to be cleaned. Other objects and attendant advantages of the present invention will readily be perceived hereafter.

The present invention relates to a lance reciprocating and rotating construction for cleaning a tube comprising base means, lance-engaging means on said base means for engaging a lance, motor means coupled to said lance-engaging means for rotating said lance and advancing it axially, and means for mounting said lance engaging means immediately adjacent a tube which is to receive said lance.

The present invention also relates to a construction for axially reciprocating a lance comprising frame means, means on said frame means for axially reciprocating a lance, carriage means remote from said lance reciprocating means for mounting an end portion of said lance, means for supporting said carriage means, and means for coupling the end of said lance supported by said carriage means to a high pressure fluid source.

The present invention also relates to a mechanism for axially reciprocating and rotating a lance comprising base means, spaced wheel means on said base means for engaging a lance, first motor means for driving said wheel means to advance said lance axially, and second motor means for causing said wheel means to revolve about the axis of said lance for rotating said lance.

The present invention also relates to a frame for mounting a lance advancing mechanism comprising frame means, attachment means for attaching said frame means relative to an end plate of a tube bundle, a carriage for mounting a lance advancing mechanism, and means on said frame means for mounting said carriage for movement transversely to said end plate. The various aspects of the present invention will be more fully understood when the following portions of the specification are read in conjunction with the accompanying drawings wherein.

Figure 7:
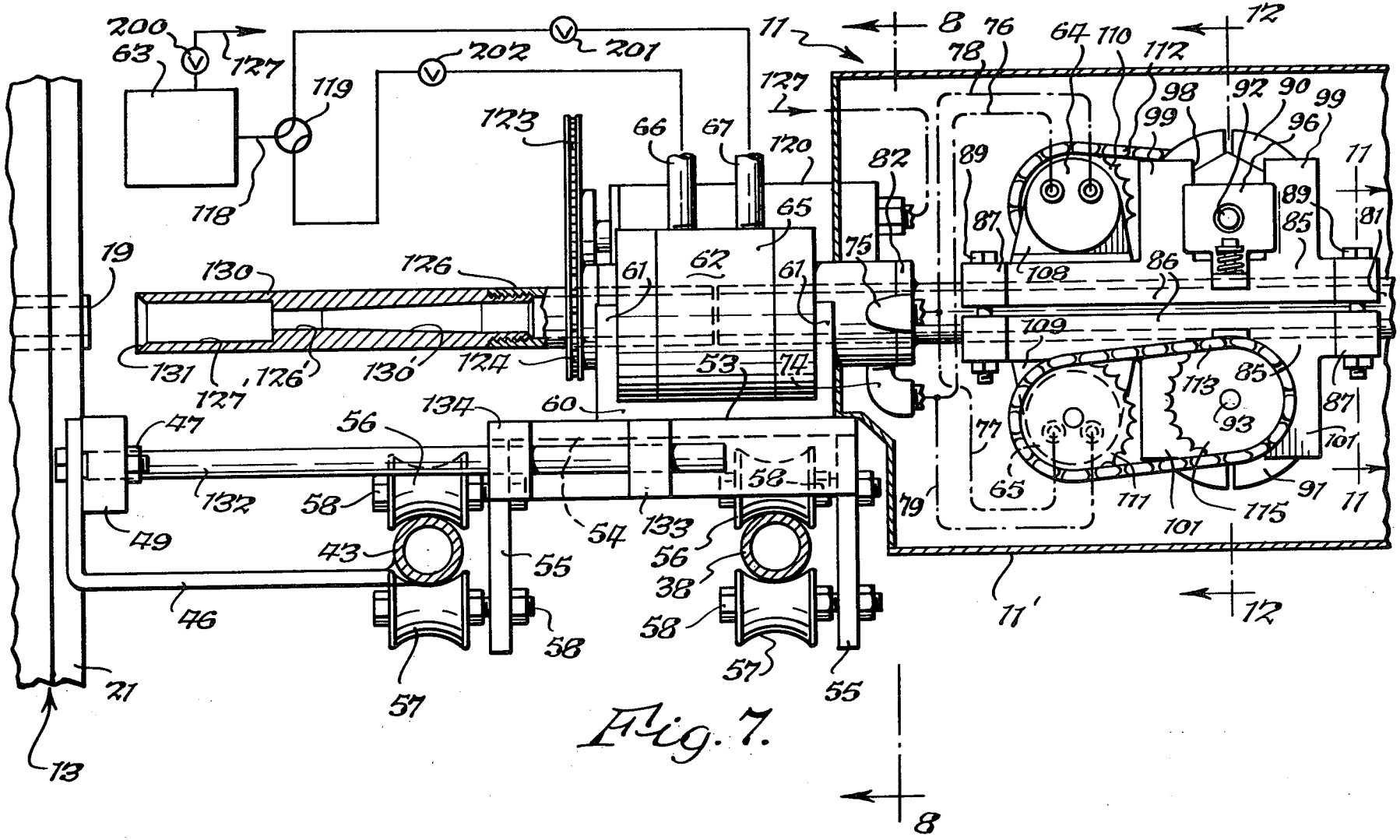
FIG. 7 is a fragmentary side elevational view, partially in cross section, showing the lance reciprocating and rotating mechanism mounted on the supporting frame and positioned relative to the tube bundle.
Figure 12:
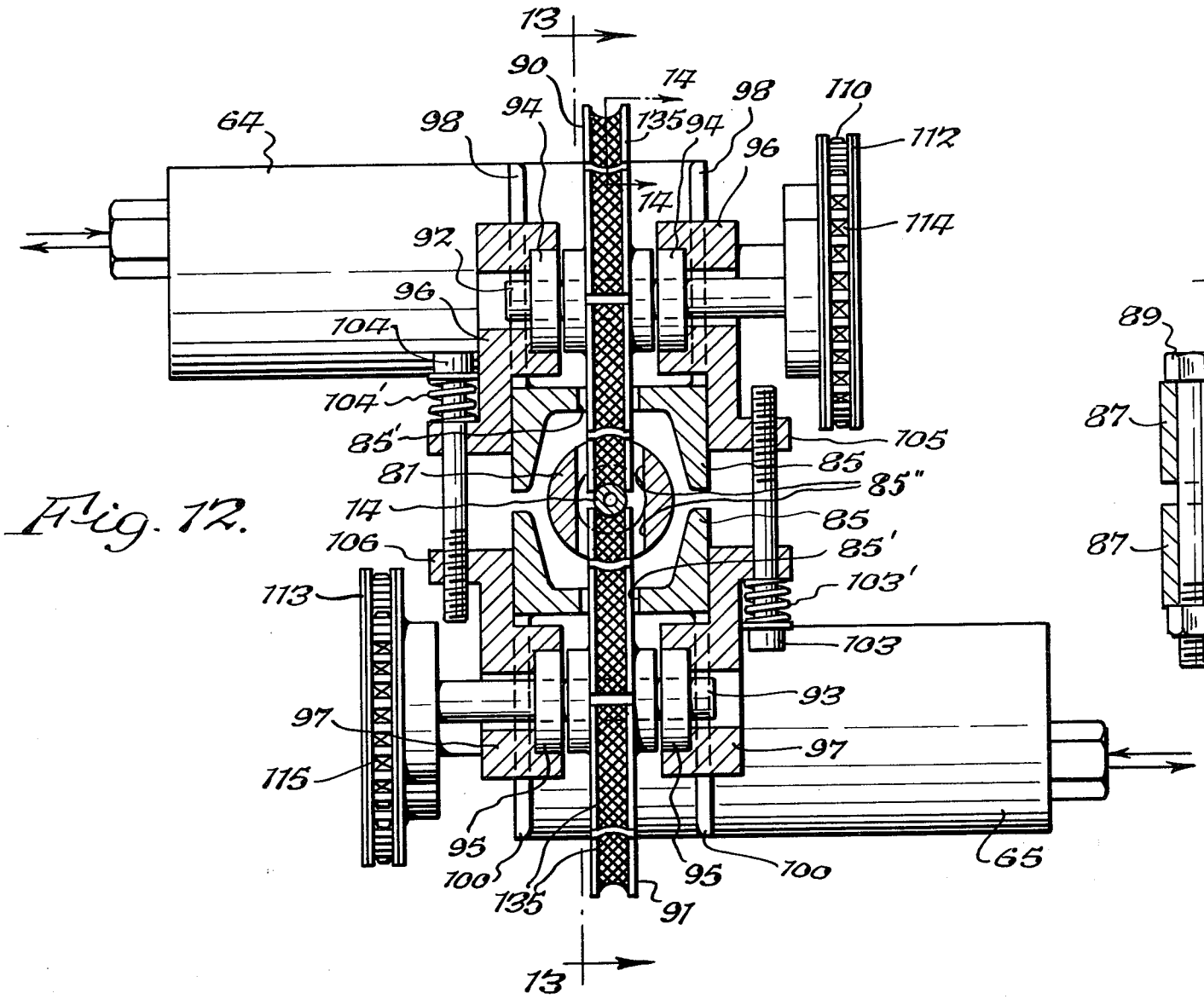
Figure 14:
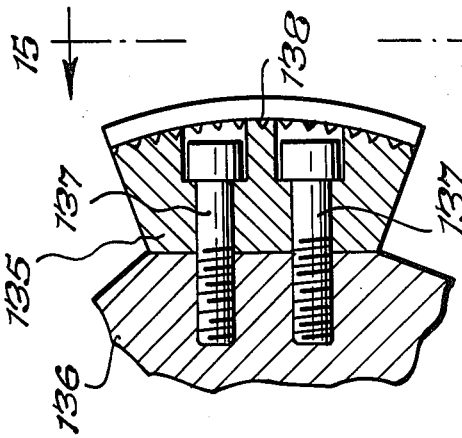
Figure 15:
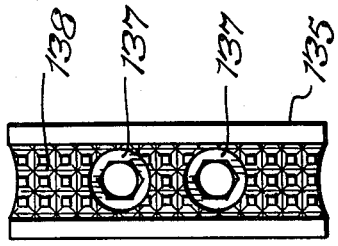
Figure 16:
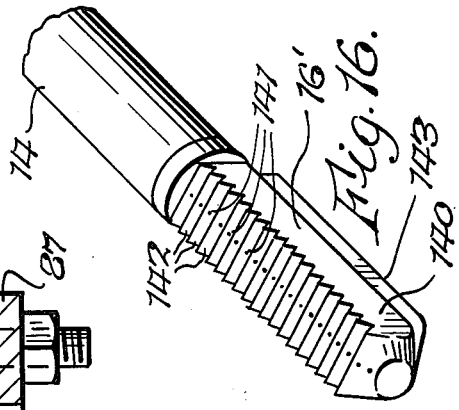
Figure 13:
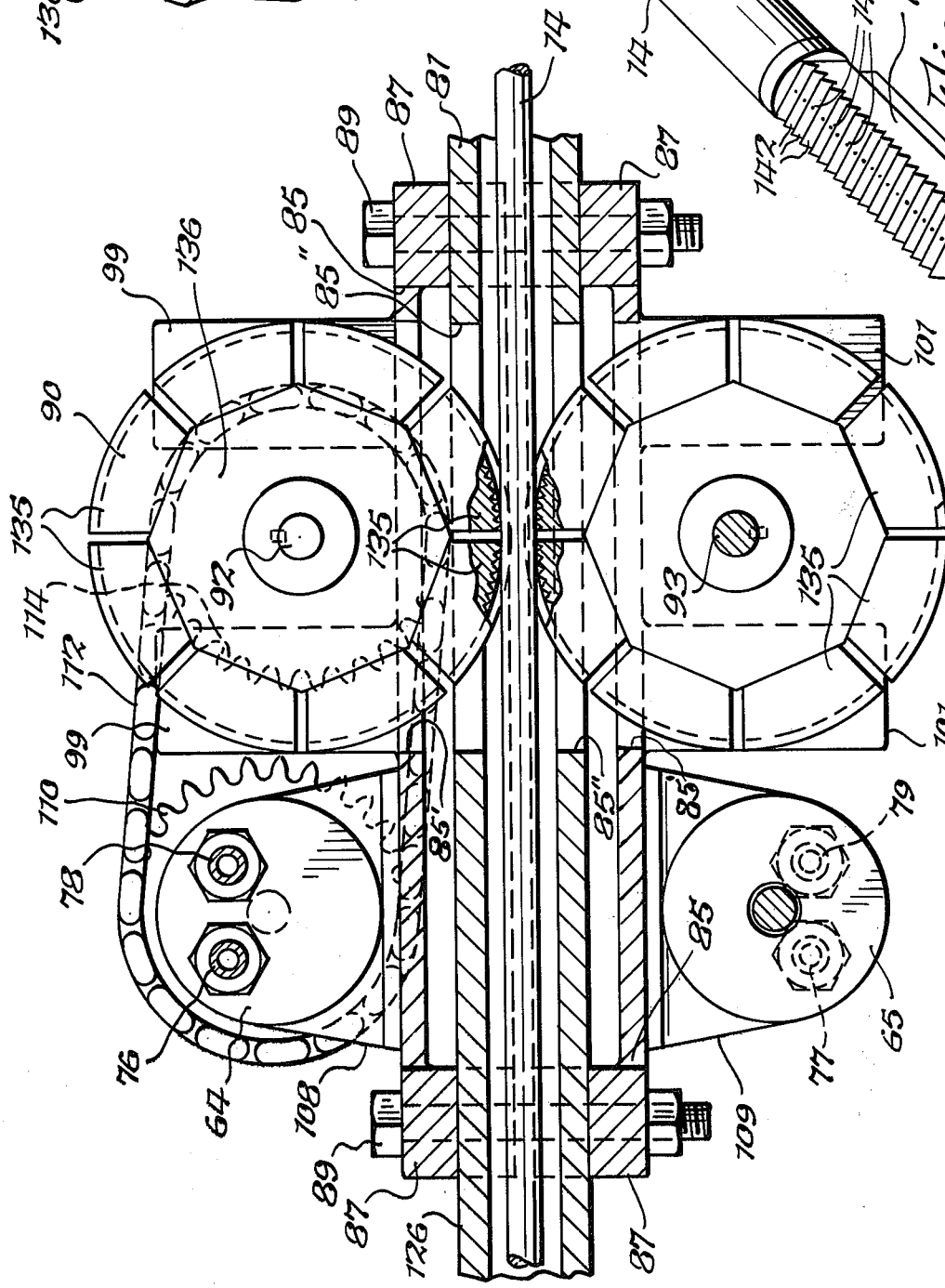
Figure 17:
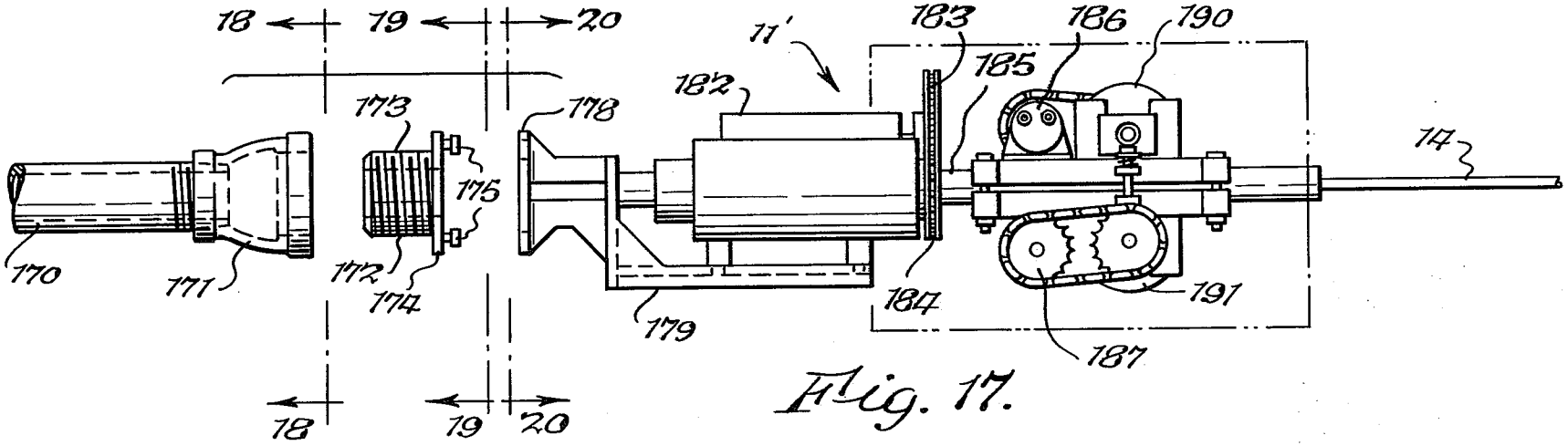
Figure 20:
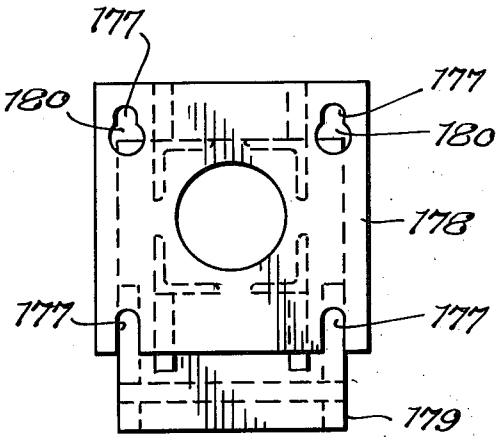
Figure 19:
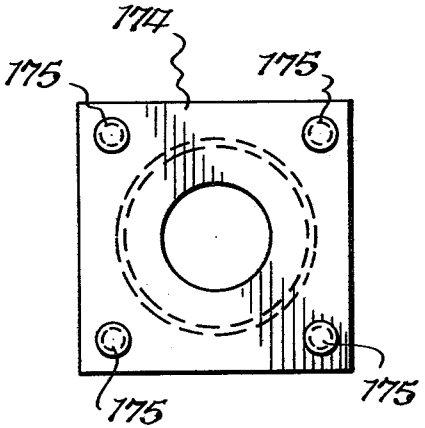
Figure 18:
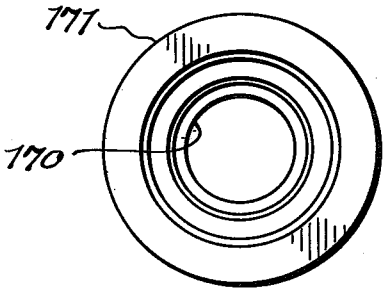
Figure 21:
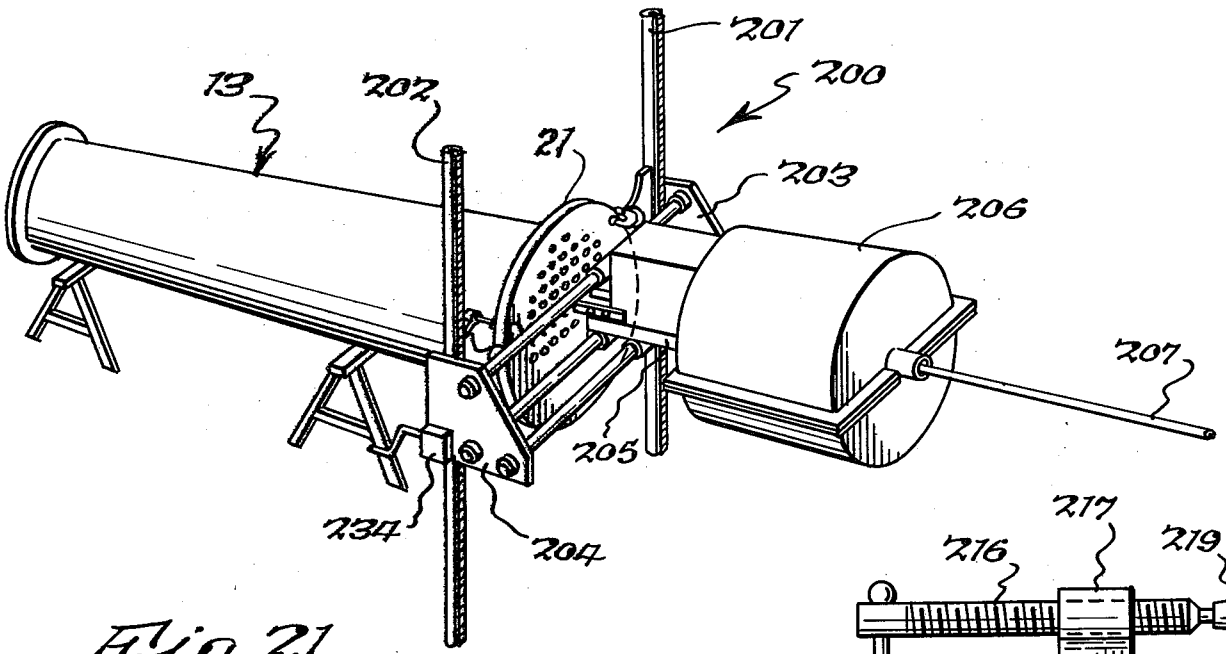
Figure 22:
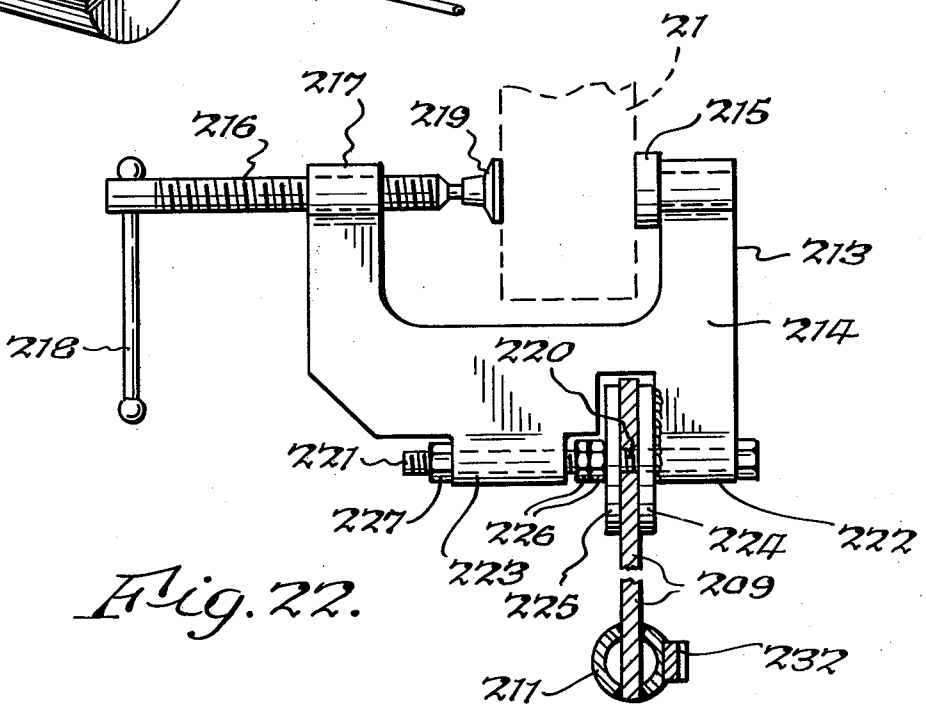
Figure 23:
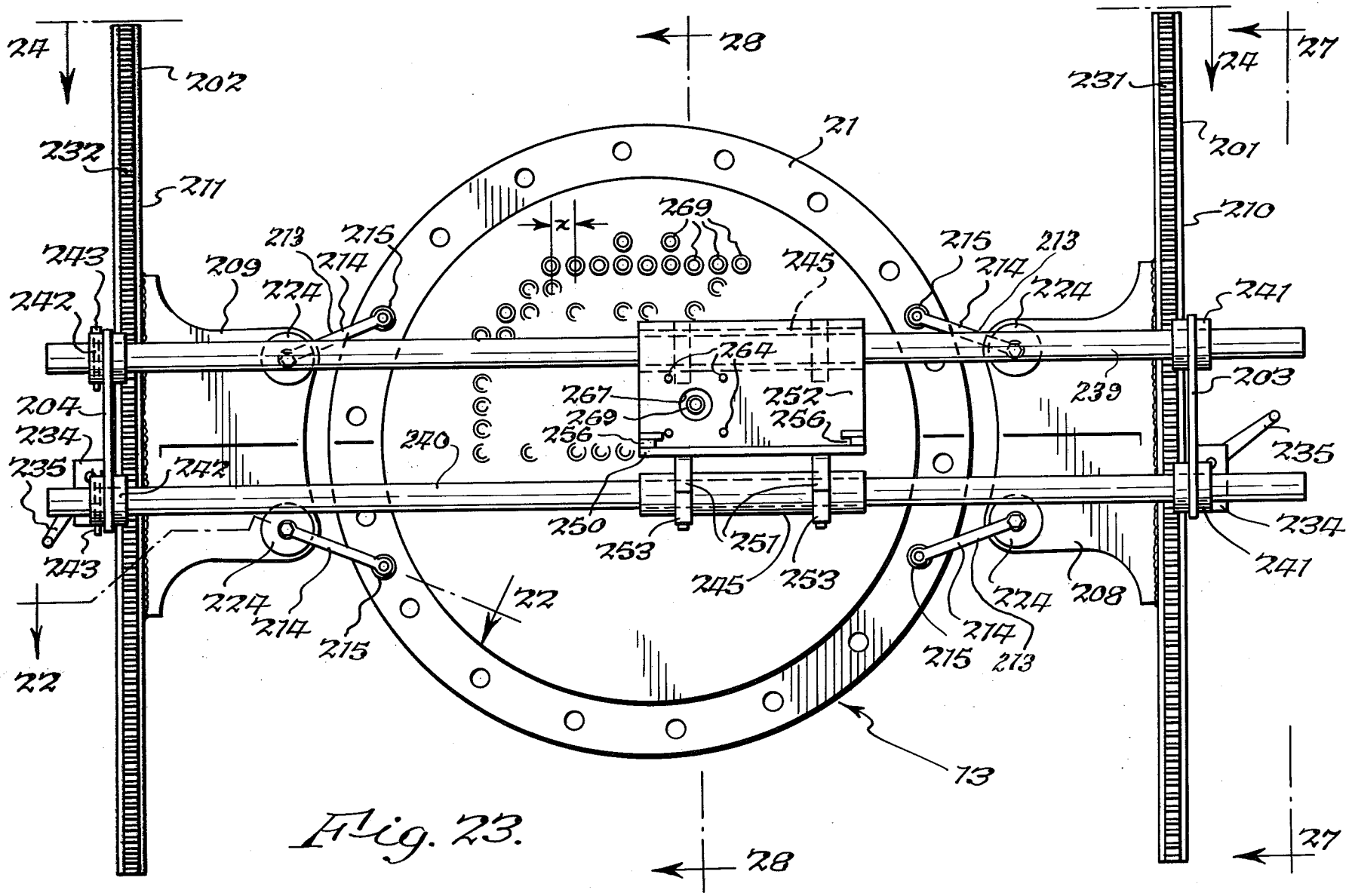
Figures 24, 25, 26:
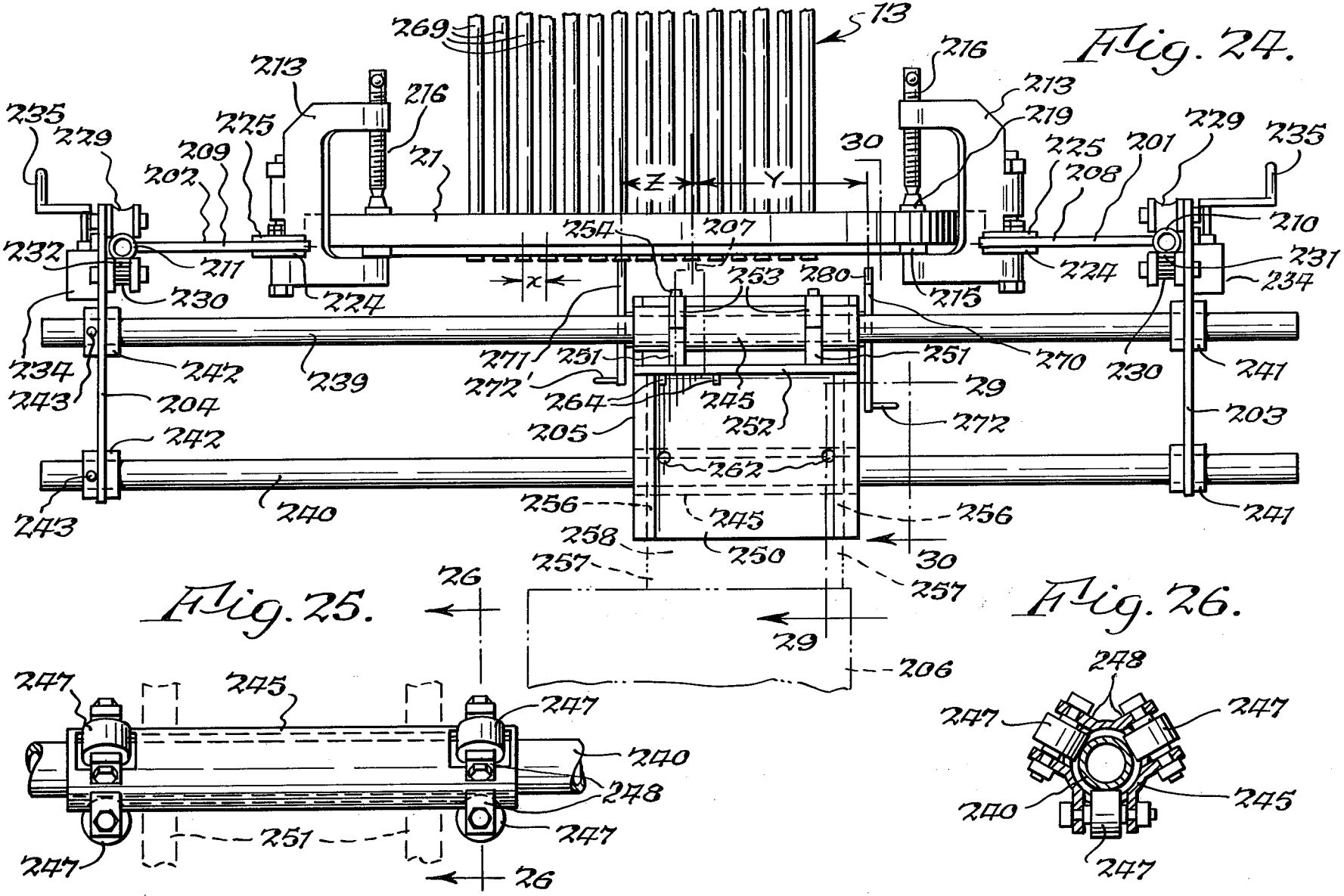
Figure 28:
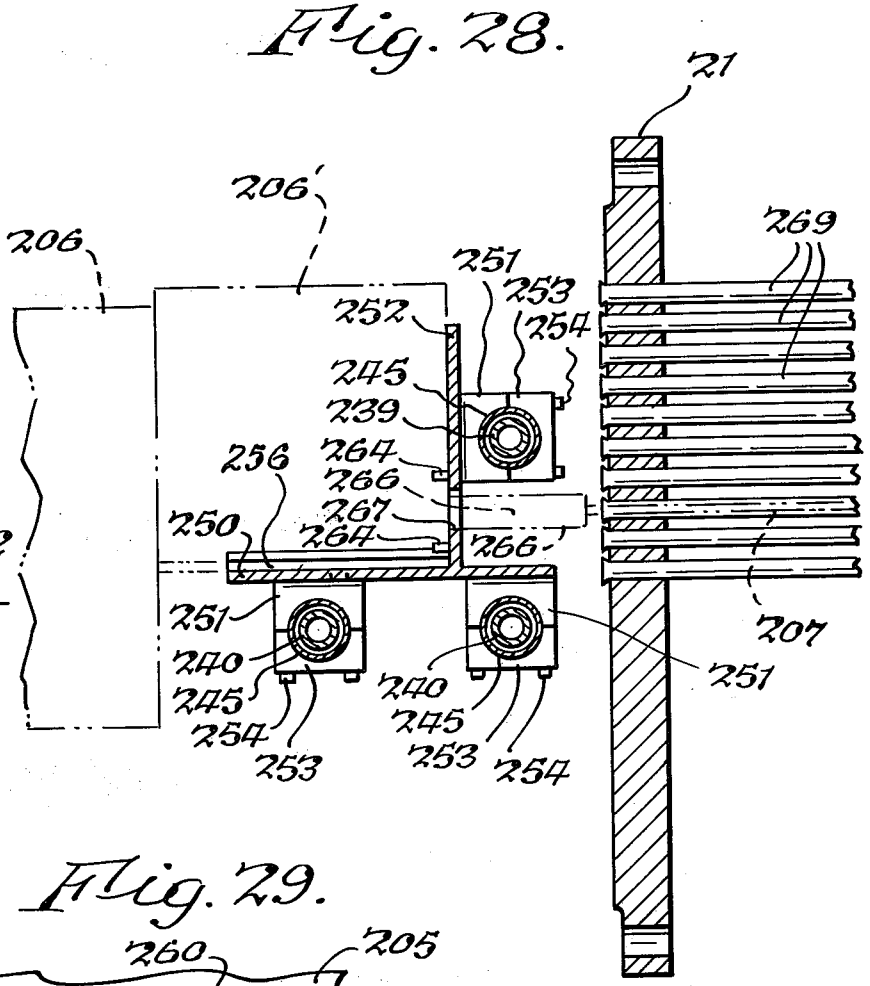
Figure 29:
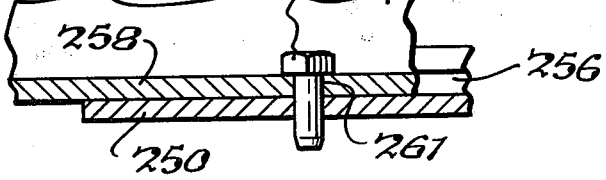
Figure 27:
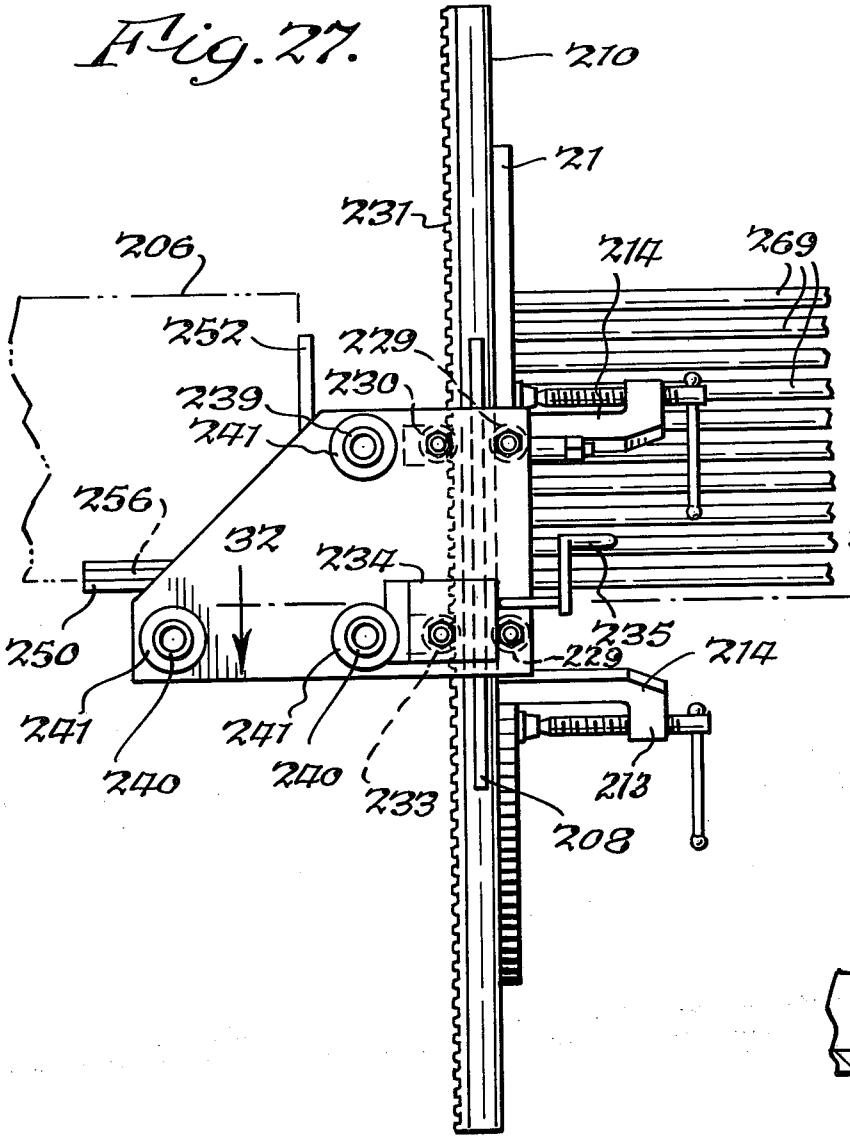
Figures 30, 31, 32, 33, 34:
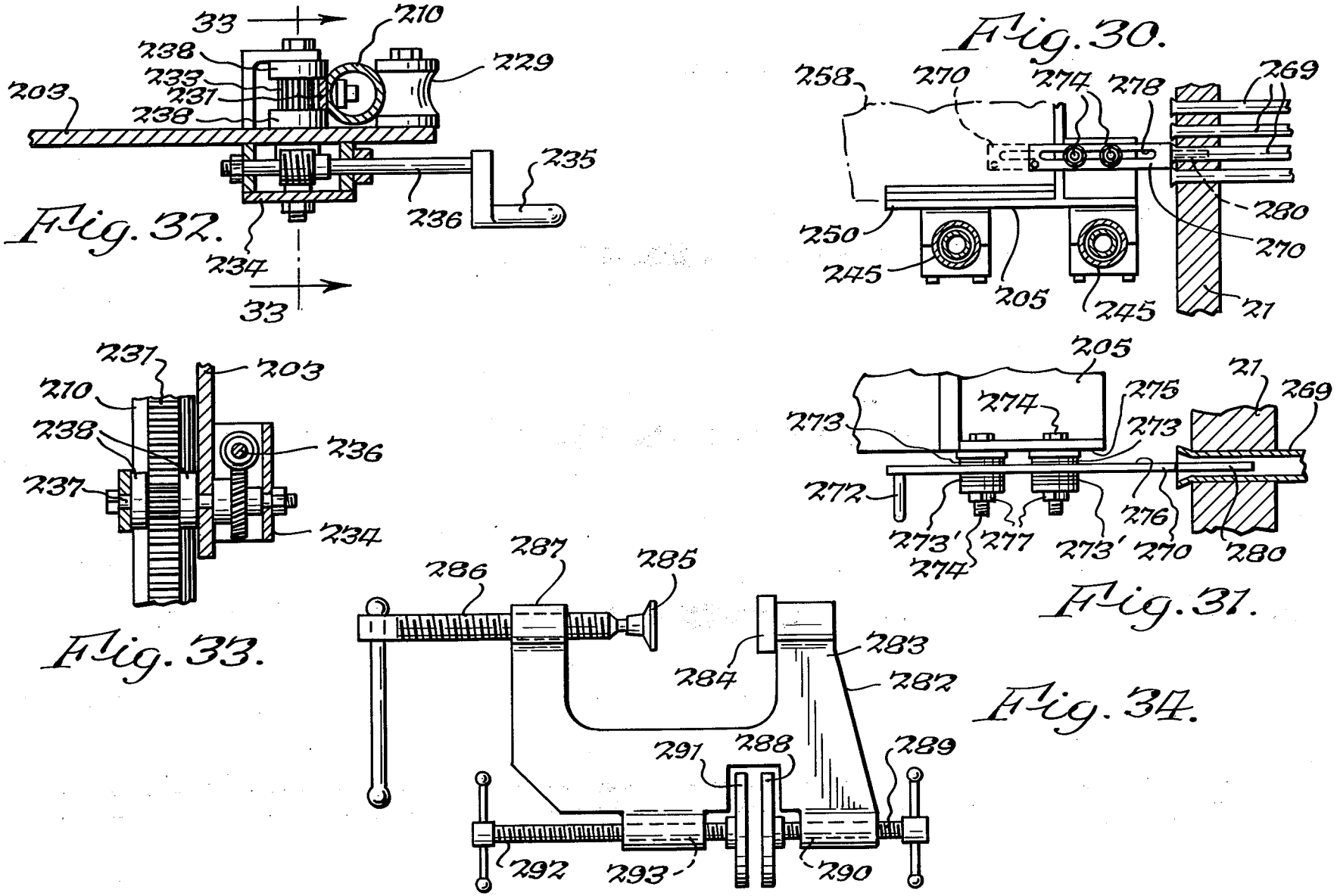

FIG. 12 is a cross sectional view taken substantially along line 12—12 of FIG. 7 and showing the drive wheels for reciprocating and rotating the lance, the tightening mechanism for adjusting the grip of the drive wheels on the lance, and the drive motors and related structure for driving the drive wheels to cause them to reciprocate the lance axially, with certain portions of the structure being omitted in the interest of clarity;

FIG. 13 is a fragmentary cross sectional view taken substantially along line 13—13 of FIG. 12;

FIG. 14 is a cross sectional view taken substantially along line 14—14 of FIG. 12 and showing the manner of attaching a peripheral segment to the drive wheel;

FIG. 15 is a view taken substantially along line 15—15 of FIG. 14 and showing the configuration of the gripping portion of the drive wheel attachment;

FIG. 16 is a fragmentary perspective view of a lance tip which may be attached to the end of the lance for cleaning the tube;

FIG. 17 is a fragmentary exploded side elevational view showing a modified form of the lance reciprocating and rotating mechanism which includes a special frame and adapters for using it with individual tubes such as those found in refinery furnaces or in boilers or the like;

FIG. 18 is an end elevational view taken substantially along line 18—18 of FIG. 17 and showing the reducer coupling or other adapter fitting as required for mounting on the end of a tube to be cleaned;

FIG. 19 is a view taken substantially along line 19—19 of FIG. 17 and showing the adapter plate-nipple which fits into the adapter coupling;

FIG. 20 is a view taken substantially along line 20—20 of FIG. 17 and showing the face of the mounting frame which fits onto the plate of the plate-nipple of FIG. 19;

FIG. 21 is a fragmentary perspective view of a modified form of frame arrangement which is highly simplified and can be secured to the end plate of a tube bundle in an extremely rapid manner;

FIG. 22 is a fragmentary cross sectional view taken substantially along line 22—22 of FIG. 23 and showing the construction of a clamping member attached to the end plate of the tube bundle and mounting a portion of the frame member;

FIG. 23 is an end elevational view of the frame mounted on the end plate of a tube bundle;

FIG. 24 is a view taken substantially along line 24—24 of FIG. 23 and showing a plan view of the frame;

FIG. 25 is a fragmentary enlarged front elevational view of the tube-roller assemblies mounted on the carriage for supporting it for rolling movement on the tracks;

FIG. 26 is a cross sectional view taken substantially along line 26—26 of FIG. 25 and showing the manner in which the rollers are mounted on the carriage supporting tubes;

FIG. 27 is a side elevational view taken substantially in the direction of line 27—27 of FIG. 23 and showing certain portions of the carriage supporting frame;

FIG. 28 is a fragmentary cross sectional view taken substantially along line 28—28 of FIG. 23 and showing especially details of the carriage and its mounting structure;

FIG. 29 is a fragmentary cross sectional view taken substantially along line 29—29 of FIG. 24 and showing the structure for locking the lance rotating and advancing mechanism onto the carriage;

FIG. 30 is a fragmentary cross sectional view taken substantially along line 30—30 of FIG. 24 and showing especially a side elevational view of the carriage indexing mechanism;

FIG. 31 is a fragmentary enlarged plan view, partially in cross section, of the indexing mechanism shown in FIG. 30;

FIG. 32 is a fragmentary cross sectional view taken substantially along line 32—32 of FIG. 27 and showing details of the rack and pinion arrangement for adjusting the elevation of the track assembly;

FIG. 33 is a fragmentary cross sectional view taken substantailly along line 33—33 of FIG. 32; and FIG. 34 is a side elevational view of an alternate type of clamp arrangement which can be used.

Summarizing in advance, the apparatus for axially reciprocating and rotating a lance includes lance reciprocating and rotating unit or means 11 mounted on frame 12 which is suitably secured relative to tube bundle 13. Lance 14, which is axially reciprocated and rotated by mechanism 11, has its end remote from mechanism 11 attached to carriage 15 mounted for reciprocatory movement on track 16 which is adjustably mounted on standards 17. Carriage 15 includes a rotating seal which permits high pressure fluid to be supplied from conduit 18 to rotating lance 14. Unit 11 moves lance 14 into and out of tube bundle 13 which comprises a plurality of tubes 19 held together by suitable structure which includes end plates 21. In accordance with an important aspect of the present invention, lance rotating and reciprocating means 11 is located immediately adjacent tube bundle 13. Therefore, there is no appreciable unsupported length of lance between means 11 and the tube bundle 13. In this respect, it will be appreciated that tube-cleaning lances may be less than one half inch in diameter and up to 40 feet long. This being the case, if it should be unsupported between the reciprocating and rotating mechanism, it could break or buckle, especially if the lance mounts a scraper-tip which requires high torque and thrust to operate effectively, as described more fully hereafter, or if it encounters resistance within the tube.

Figures 5, 6:
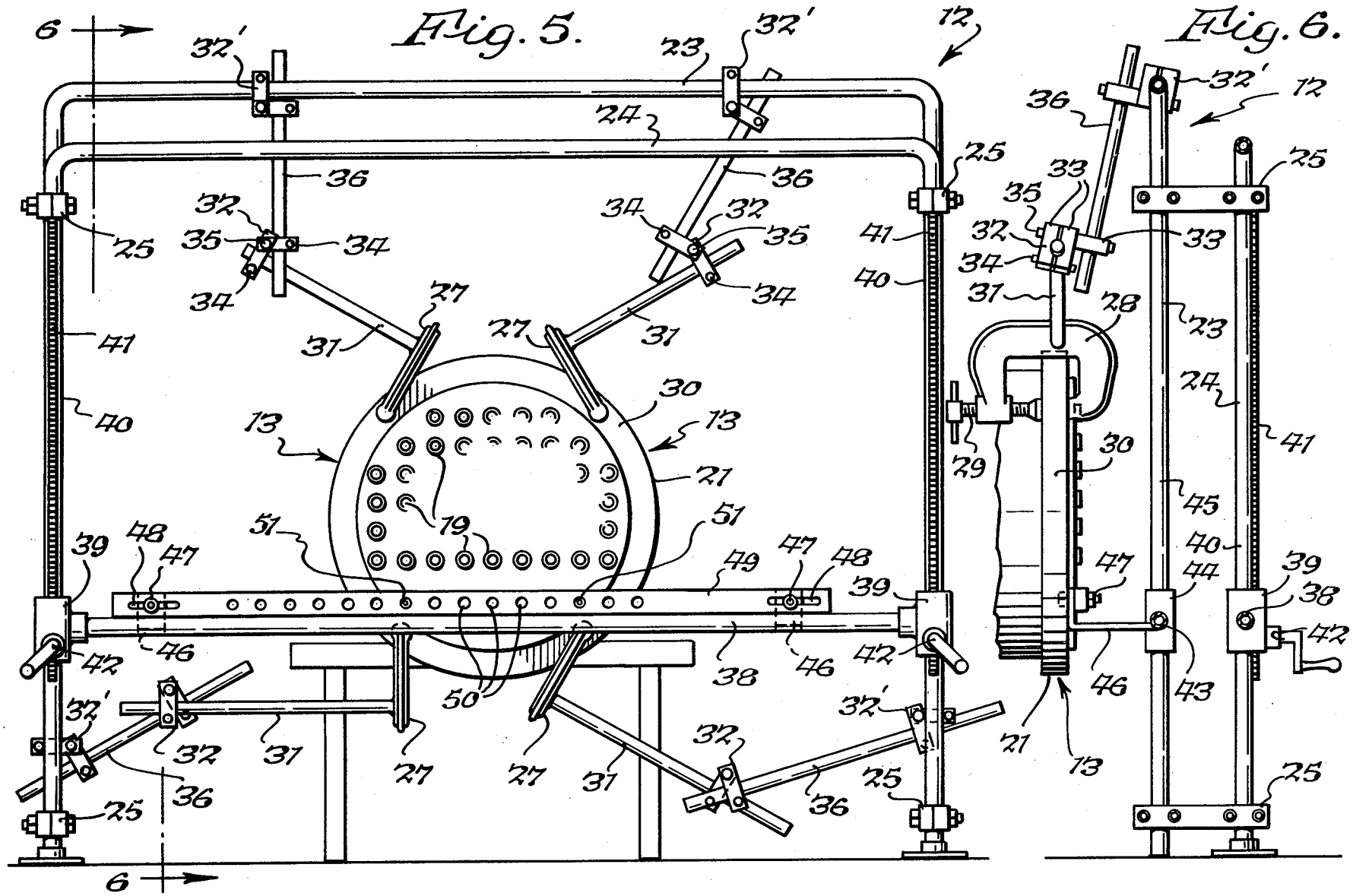
FIG. 5 is an end elevational view of a tube bundle with the frame for supporting the lance rotating and reciprocating mechanism secured thereto.
FIG. 6 is a fragmentary cross sectional view taken substantially along line 6—6 of FIG. 5 with certain parts omitted in the interest of clarity.

In order to mount unit 11 immediately adjacent tube bundle 13, frame 12 is provided. Frame 12 includes first and second inverted U-shaped frame members 23 and 24 (FIGS. 5 and 6) which are fastened to each other by bracket assemblies 25. A plurality of C-clamp units 27 having a C frame 28 and a screw member 29 are clamped to rim 30 of end plate 21. Each clamp member 27 has a rod 31 welded thereto. Universal connector 32 is mounted on each rod 31. Each universal connector 32 includes four blocks 33, with each pair of blocks having aligned bores for receiving nut and bolt assemblies 34. A nut and bolt assembly 35 secures one pair of block units 33 to an adjacent pair of block units 33. Therefore, one pair of block units 33 can be clamped onto rod 31 and the other pair of block units 33 can be clamped to another rod 36. When associated rods 31 and 36 are positioned in their desired orientation, nut and bolt assemblies 34–35 are tightened. Additional universal connectors 32', which may be identical in all respects to connectors 32, are mounted on rods 36 and are attached to various portions of frame member 23, as shown in FIGS. 5 and 6. Because of the universal connections between clamp members 27 and frame member 23, frame 12 can be mounted relative to any type of tube bundle. While a specific type of universal connector has been shown, it will be appreciated that other types can be used with equal facility.

A rod 38 has its opposite ends mounted on sleeves 39 which encircle vertical legs 40 of frame member 24. Racks 41 are formed on legs 40. A pinion or worm gear, not shown, which is actuated by rotating crank 42 on sleeve 39, is selectively turned while engaged with the teeth of racks 41 to adjust bar 38 to any desired elevation. A bar or rod 43 (FIGS. 1 and 6) has its opposite ends mounted on sleeves 44 which can move longitudinally of legs 45 of frame member 23. Suitable clamp members, not shown, are provided for maintaining sleeves 44 in any adjusted position on legs 45. Angle brackets 46 have their horizontal legs welded to bar 43 (FIGS. 5 and 6) and their vertical legs carry nut and bolt assemblies 47 which are received in slots 48 of template bar 49 having a plurality of spaced apertures 50 therein. Apertures 50 have the same spacing and diameter as the internal diameter of tubes 19 of tube bundle 13. Two pins 51 with an outer diameter slightly less than the inner diameter of tubes 19 are inserted into apertures 50 and tubes 19 to rigidly secure bar 49 to the face of tube bundle 13. Different size bars 49 may be mounted on brackets 46 so that a bar which matches with the spacing of tubes 19 may be used with any particular type of tube bundle. When the bars 38 and 43 are to have their elevations changed, the two pins 51 are removed from apertures 50 to permit template 49 to move with bar 43. After the movement is completed, the two pins 51 are reinserted into different tubes 19 at the new position. The manner in which template bar 49 functions will be described at an appropriate point hereafter.

The lance rotating and reciprocating unit 11 is mounted on base 53 (FIG. 7) which in turn is mounted on rods 38 and 43 for movement axially thereof. In this respect, base 53 includes an upper plate 54 connecting spaced parallel vertical plates 55. Each plate 55 rotatably mounts a pair of upper concave rollers 56 and a lower concave roller 57 by means of suitable lubricatable axles (not numbered) which are mounted on plates 55 by nut and bolt assemblies 58.

Figure 10:
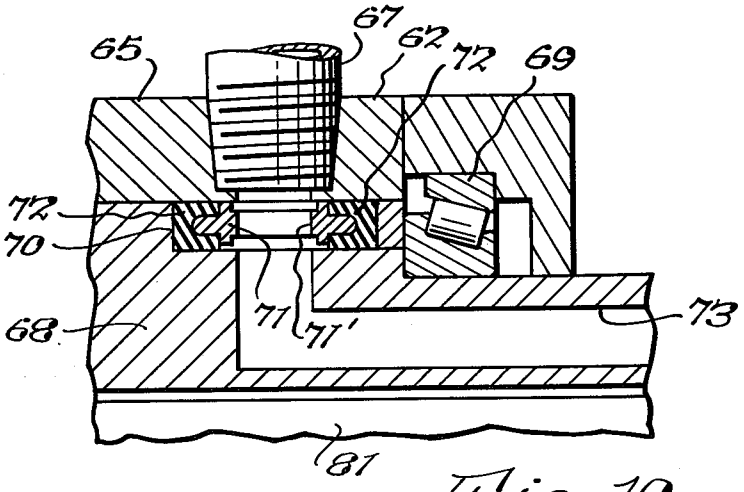
FIG. 10 is an enlarged fragmentary cross sectional view also taken along line 9—9 of FIG. 8 and showing in greater detail the structure of the seal portion of the rotating seal and the bearings therein.
Figure 9:
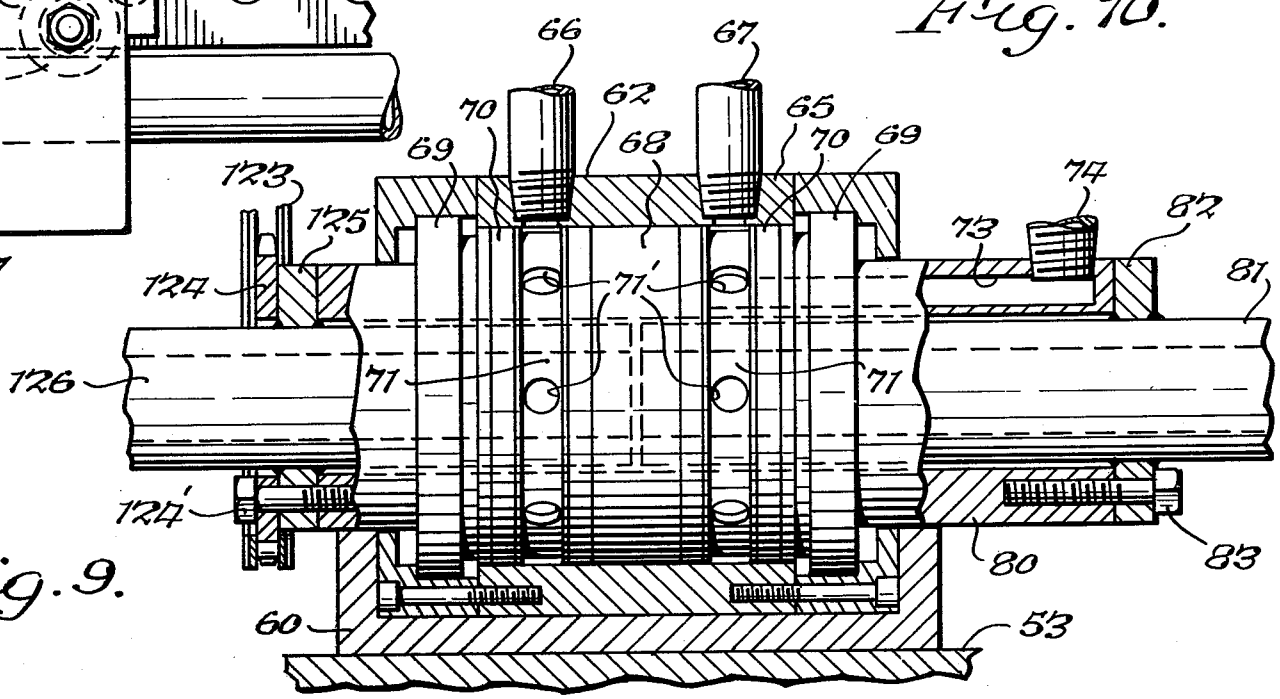
FIG. 9 is an enlarged fragmentary cross sectional view taken substantially along line 9—9 of FIG. 8 and showing the rotating seal for conducting compressed air to the air motors which advance the lance while imparting rotation thereto.

A pedestal 60, which includes spaced plates 61, mounts a rotating seal 62 which receives compressed air from source 63 and provides it to air motors 64 and 65 (FIG. 7) but other types of fluid motors may be used. Rotating seal 62 includes an outer housing portion or stator 65 having conduits 66 and 67 communicating therewith. A rotor 68 (FIG. 9) has spaced portions mounted in bearings 69. Sealing members 70 (FIGS. 9 and 10) are provided between stator 65 and rotor 68 to permit compressed air to pass into rotor 68. In this respect, sealing members 70 include perforated rings 71 having their edge portions supported by packings 72. Thus, compressed air passing through conduit 67 will pass through apertures 71' in perforated ring 71, into conduit 73 in rotor 68 and into tube conduit 74. The compressed air flowing through conduit 66 passes through the apertures 71' in its respective ring 71 and then passes through a conduit, not shown, in rotor 68 which is analogous to conduit 73 and which terminates at conduit 75. Conduit 74 is in communication with conduits 76 and 79 (FIG. 7) leading to air motors 64 and 65, respectively. Conduit 75 is in communication with conduits 78 and 77 which are in communication with air motors 64 and 65, respectively. Viewing motors 64 and 65 from FIG. 7, it is to be understood that they rotate in opposite directions for reasons which will become more apparent hereafter. Rotor 68 includes as an integral portion thereof extension 80 (FIG. 9). A hollow pipe 81 has a collar 82 welded thereto. Collar 82 is fastened to rotor portion 80 by means of a plurality of bolts 83 which extend circumferentially around collar 82.

Figure 11:
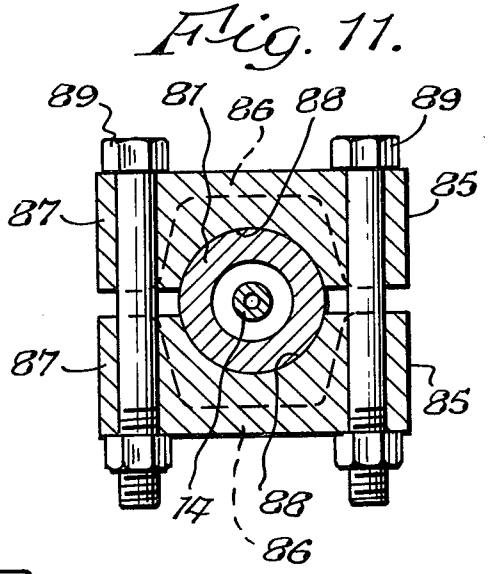
FIG. 11 is a cross sectional view taken substantially along line 11—11 of FIG. 7 and showing a portion of the mounting structure for the lance reciprocating and rotating motors and related structure.

The structure which mounts motors 64 and 65 is mounted on hollow pipe 81. In this respect, the two base members 85 (FIGS. 7 and 11) each include elongated central portions 86 which terminate at bosses 87 which include concave portions 88 having a configuration for complementary mating engagement with the outside of pipe 81. Nut and bolt assemblies 89 extend through aligned apertures in bosses 87 to clamp base members 85 securely to pipe 81.

Drive wheels 90 and 91 are provided for engaging lance 14 for driving it axially through tube 81. Drive wheels 90 and 91 are keyed to shafts 92 and 93, respectively, which in turn are mounted in bearings 94 and 95, respectively, which in turn are supported in slide members 96 and 97, respectively. Slide members 96 are slidable in ways 98 formed by posts 99 formed integrally with base members 85. Analogous ways 100 (FIG. 12) are formed for providing sliding movement to blocks 97, ways 100 being formed by members 101 (FIG. 7) formed integrally with base 85. By manipulating bolts 103 and 104 which have their threaded portions in threaded engagement with flanges 105 and 106 of slide members 96 and 97, respectively, each pair of slide members 96–97 may be drawn together or moved apart which in turn causes drive wheels 90 and 91 to move together or apart. By the manipulation of screws 103 and 104, the degree of tightness of drive wheels 90 and 91 with lance 14 may be adjusted. Drive wheels 90 and 91 extend through slots 85' in base members 85 and through slots 85" in pipe 81 (FIG. 12). Springs 103' and 104', which are positioned between the heads of bolts 103 and 104, respectively, and suitable flanges on slide members 97 and 96, respectively, maintain the proper pressure between lance 14 and drive wheels 90 and 91.

Air motors 64 and 65 are mounted on pedestals 108 and 109 (FIG. 13), respectively, which in turn are rigidly secured to base members 85. Air motors 64 and 65 have sprockets 110 and 111, respectively, keyed to the output shafts thereof. Chains 112 and 113 are in driving engagement with sprockets 110 and 111, respectively, and are also in driving engagement with sprockets 114 and 115, respectively, which are keyed to shafts 92 and 93, respectively, on which drive wheels 90 and 91, respectively, are keyed.

In order to drive motors 64 and 65 compressed air is supplied thereto from source 63 (FIG. 7) via conduit 118, four-way valve 119, conduit 67 and conduit 74. Conduit 76, which is in communication with conduit 74, is also in communication with motor 64. Conduit 79, which is in communication with conduit 74, is also in communication with motor 65. As noted above, motors 64 and 65 are set up to rotate in opposite directions. To advance the lance from right to left in FIG. 7, motor 64 will rotate in a clockwise direction and motor 65 will rotate in a counterclockwise direction. This in turn causes wheel 90 to rotate in a clockwise direction and wheel 91 to rotate in a counterclockwise direction. The exhaust from motors 64 and 65 is passed through conduits 78 and 77, respectively, which are in communication with conduit 75 which in turn is in communication with conduit 66 leading to four-way valve 119 which is in communication with an exhaust port. If it is desired to change the direction of rotation of motors 64 and 65 so as to cause lance 14 to move from left to right in FIG. 7, as would be required in withdrawing it from a tube 19, the position of four-way valve 119 is changed so as to cause high pressure compressed air to be supplied to conduits 77 and 78 and to permit the exhaust air to pass through conduits 76 and 79. Motors 64 and 65 and their associated structure is housed within a cylindrical sheet metal casing 11'' suitably attached relative to pedestal 60. Casing 11'' protects the parts which it encloses against excessive exposure to dirt and water spray and also prevents workers from coming in contact with the equipment as it rotates when in operation.

Figure 8:
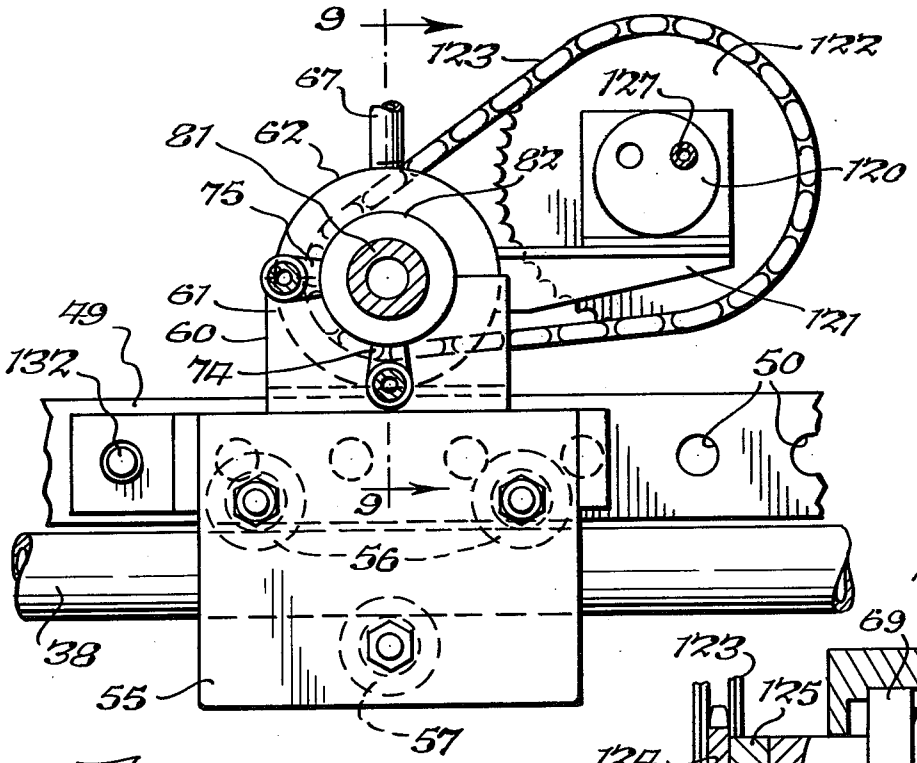
FIG. 8 is a fragmentary cross sectional view taken substantially along line 8—8 of FIG. 7 and showing the motor for imparting rotation to the remainder of the assembly which rotates the lance about its longitudinal axis.

In order to rotate lance 14, an air motor 120 is provided (FIG. 8). Motor 120 is mounted on bracket 121 which in turn is mounted on base 60. The drive sprocket 122 of motor 120 is encircled by chain 123 which in turn encircles sprocket 124 (FIGS. 7 and 9) which is bolted to collar 125 welded to tube 126 which is in axial alignment with tube 81. Collar 125 is an integral (welded) part of tube 126 which is bolted onto rotor 68. Compressed air is supplied to motor 120 through conduit 127 which is in communication with compressed air source 63 through a suitable valve 200. It can thus be seen that the rotation of rotor 68, which is effected by the driving force produced by motor 120, will cause rotation of tube 81 on which motors 64 and 65 and wheels 90 and 91 are mounted. This will cause lance 14 to be rotated about its longitudinal axis because of its driving engagement with wheels 91 and 90 which are being revolved about the axis of lance 14 as these drive wheels are being rotated to cause lance 14 to move axially. While a pneumatic system has been disclosed for driving the various motors, it will be appreciated that any other types of motors may be used, except that non-electric motors are preferred in explosive environments.

A tube extension 130 is attached to tube 126 (FIG. 7). Tube 130 is selected to be of a length so that its end 131 will be as close as possible to the end of the tube 19 which is to be cleaned, thereby aiding in guiding the lance into the tube. As indicated in FIG. 7, tube 130 is shaped internally with a tapered entrance 130' in its right end to ease entry of the lance into tube 130. It is shaped in its central portion 126' to have an inner diameter slightly larger than the lance in use to serve to center the lance in tube 130 and thereby aid in guiding lance 14 and tip 16' into tube 19. This smaller inner diameter also prevents tip 16' from being retracted into driving wheels 90 and 91. The enlarged section 127' of tube 130 serves as a holding receptacle for tip 16' when lance 14 is retracted from tube 19 so as to prevent damage to tip 16' when the apparatus is moved from one tube 19 to another tube 19. This receptacle also contains water spraying from tip 16' and thereby prevents workmen from getting wet during the time the apparatus is being moved. Tubes 130 with different sized internal configurations are used with various sized lances 14 as required for cleaning various sized tubes 19.

In order to effect the proper alignment between the lance 14 and the tube which is to be cleaned, an alignment rod 132 is provided (FIG. 7). Rod 132 is longitudinally slidable in bosses 133 and 134 which are secured to base 53. After guide template 49 (FIGS. 5 and 7) has been properly aligned, the insertion of rod 132 in any of apertures 50 of guide template 90 will cause proper alignment between lance within tube 130 and a tube in the tube bundle. Thus, for example, after the cleaning of one tube of the tube bundle is terminated, the lance is withdrawn from tube 19. Thereafter, the guide bar 132 is withdrawn from one hole 50 in guide template 49, and the guide bar 132 is thereafter inserted into an adjacent hole 50, which can only be effected after carriage 53 has been moved laterally the proper amount, and this will result in proper alignment of lance 14 to clean another tube 19. After cleaning of a horizontal row of tubes 19 has been completed, the elevation of the lance advancing and rotating unit 11 is adjusted in the manner explained above and guide template 49 is also adjusted. Thereafter, another entire horizontal row of tubes 19 may be cleaned by use of the alignment and indexing mechanism 49–132.

Drive wheels 90 and 91 may be made of one piece or segmented, that is, their peripheral portions may be formed by a plurality of segments which are secured to polygonal hub 136 by means of screws 137 (FIGS. 13 and 14). The reason for providing segmented drive wheels is to permit the peripheries of the wheels to tightly engage different sizes of lances. For example, for lances of greater outer diameter segments 135 of greater curvature would be used and vice versa. By using segments, such as 135, there is no need to replace the entire wheel, such as 91 or 90. On the other hand, if desired, the wheels themselves can be replaced by disassembling them from their supporting base structure and remounting other wheels of the required outer peripheral configuration. Preferably the surfaces 138 of the segments 135 are knurled as shown to provide extremely positive traction for both driving the lance 14 in a rotary and axial direction.

A lance tip construction which may be mounted on the end of lance 14 is shown in FIG. 16. This construction 16' includes a body portion 140 having a plurality of bores 41 extending through surfaces 142 for directing jets of high pressure liquid both forwardly and toward the inside surface of the tube. A blade 143 is also formed on the lance tip 140 for providing a scraping action. The specific construction of lance tip 140 forms no part of the present invention but is described and claimed in my copending application Ser. No. 611,072, filed Sept. 8, 1975. It will be appreciated that the reaction from the jets of water leaving tips of this type induce both a high torque and thrust on a lance which is rotating and axially moving the tips, that is, the reaction produced by the water forces the blade against the wall of the tube being cleaned and also tends to move the lance axially in a direction opposite to the direction of the water jets. Superior cleaning is achieved by such tips because of the scraping action and the prying or spalling action applied to an incrustation by the water jets. Yet it is also true the above two forces resulting from the water-produced reaction tend to buckle and corkscrew a lance not totally constrained along its loaded length. However, in the subject invention, the lance is suitably constrained by tubes 81 and 19 and because the reciprocating mechanism is immediately adjacent tube 19, the lance portion entering the tube is so short that it cannot buckle.

As discussed in detail above, lance 14 is reciprocated axially and rotated during the cleaning of the tube bundle. Lance 14 is usually a small diameter tube between 20 and 40 feet long. The lance has been advanced at a rate of between 5 and 100 feet per minute and has been rotated between 10 and 500 rpm while it is being advanced. The speed of rotation and the speed of axial movement is controlled by controlling the rate of air flow to motors 120 and 64–65, respectively, by the use of suitable valves 200 and 201–202, respectively. For example, when motors 64 and 65 are driving the lance to the left in FIG. 7, valve 201 is adjusted to the proper air flow and valve 202 is opened completely to vent the motors. When motors 64 and 65 drive the lance to the right in FIG. 7, valve 202 is adjusted for the proper air flow and valve 201 is opened for venting the motors. The amount valve 200 in conduit 127 is opened determines the speed of rotation of motor 120 which imparts rotation to the lance. All of the structure mounted on base members 85 is structurally symmetric and thereby balanced so that it will rotate smoothly.

It is necessary to maintain lance 14 in alignment with tubes 81 and 126 through which it passes and it is also necessary to prevent the end of lance 14 remote from the tube bundle from whipping around. In addition, it is necessary to supply the end of lance 14 with high pressure liquid. To achieve all of the foregoing, the supporting structure shown in FIGS. 1–4 is provided.

Figure 1:
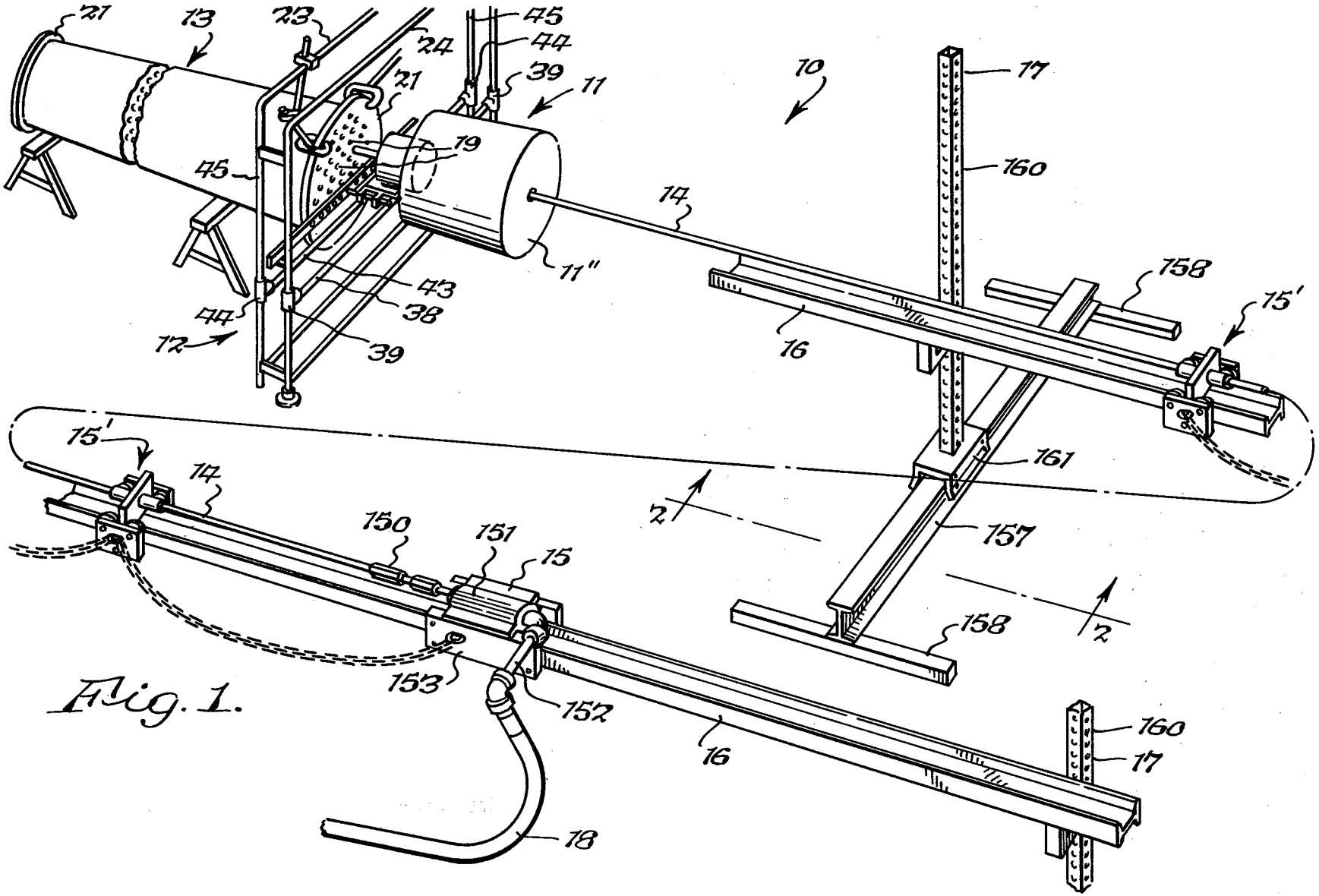
FIG. 1 is a fragmentary perspective view of the improved cleaning apparatus mounted relative to a tube bundle.
Figures 2, 3, 4:
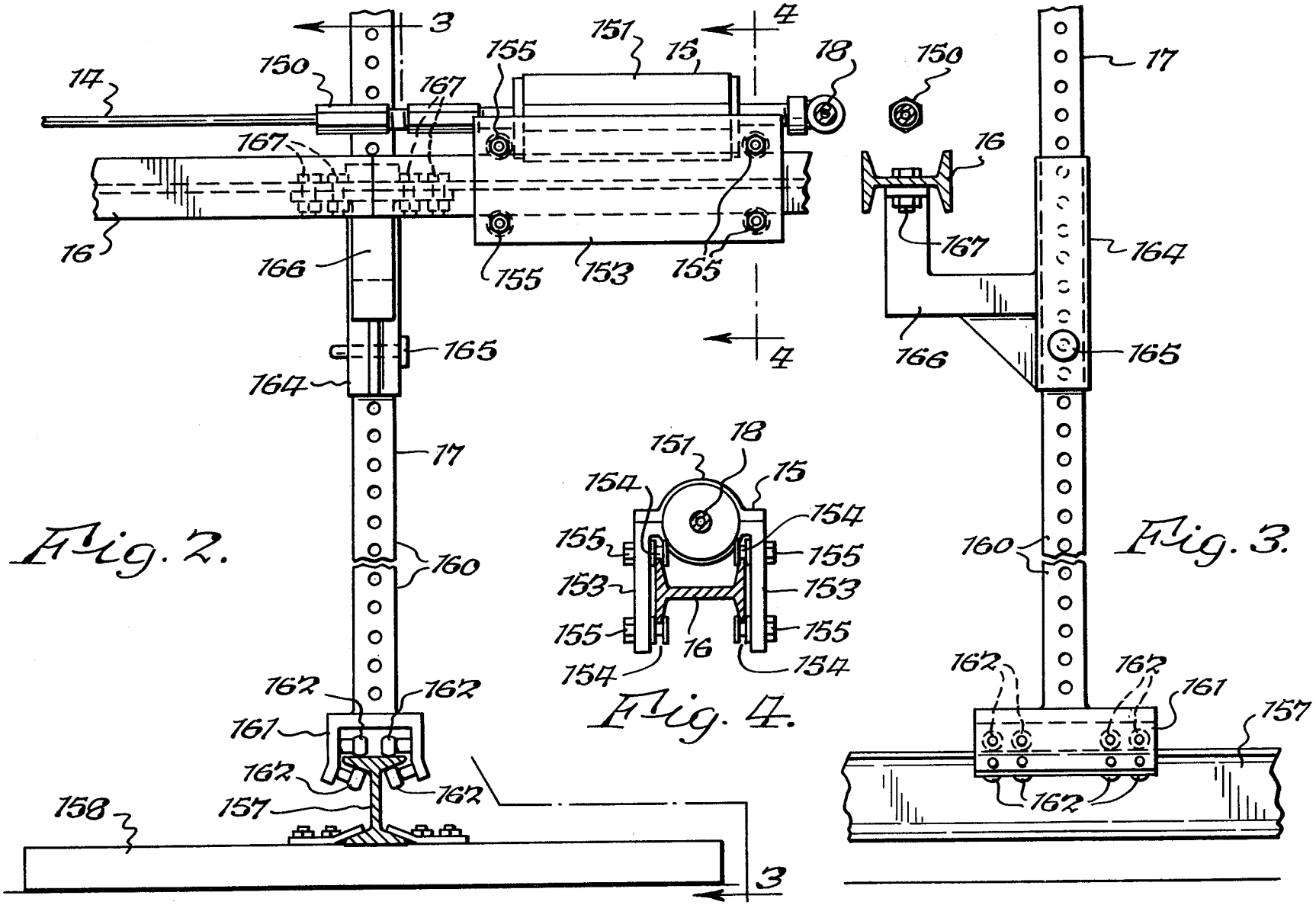
FIG. 2 is a fragmentary cross sectional view taken substantially along line 2—2 of FIG. 1 and showing the construction of the standard for mounting the track which supports the carriage which connects the water inlet pipe to the rotating lance.
FIG. 3 is a fragmentary cross sectional view taken substantially along line 3—3 of FIG. 2 and showing further details of construction of the standard.
FIG. 4 is a cross sectional view taken substantially along line 4—4 of FIG. 2 and showing the manner in which the carriage is mounted on its track.

The end of lance 14 is coupled by coupling 150 to rotating seal 151 mounted on carriage 15. A source of high pressure liquid, not shown, provides high pressure water to conduit 18 which is connected to conduit 152 which in turn is connected to rotating seal 151 which causes this liquid to pass into lance 14. Carriage 15 is mounted on track 16 which is essentially an I-beam. Carriage 15 includes a pair of sides 153 mounting eight spaced rollers 154 which are mounted on bolt assemblies 155. Because rollers 154 engage the upper and lower edges of the I-beam, as shown in FIG. 4, good solid support is provided for the end of lance 14 against whipping about during rotation. Lance guides 15', shown in FIG. 1, are also placed on track 16 to provide additional support for lance 14 and to further prevent lance 14 from whipping. Lance 14 extends though a bore in each guide 15'. These guides are spaced along track 16 and attached to one another and to swivel 151 by means of a small rope or chain. Each lance guide 153' includes a mounting structure similar to that shown for carriage 15 in FIGS. 2 and 4 for permitting guides 15' to roll on track 16. As lance 14 enters tube 19 carriage 15 drives guides 15' to the left and they in turn contact one another and are driven to the left on track 16. As lance 14 is retracted from tube 19 carriage 15 pulls the rope or chain on the lance guides and respaces the lance guides the full length of lance 14 in track 16. The number of lance guides 15' used depends on the length and rigidity of lance 14 in use. Track 16 is supported by a plurality of spaced standards 17.

Each standard 17 includes a base portion consisting of I-beam 157 having its ends mounted on cross members 158. In use a plurality of standards 17 are placed in alignment so as to support track 16. The number of standards 17 which are used depends on the length of the lance 14 in use and that in turn determines the length of track 16 used. Generally, anywhere from three to six standards 17 may be employed. A vertical perforated member 160 has its lower end rigidly secured to an inverted channel member 161 which carries a plurality of rollers 162 therein. This permits vertical member 160 to move lengthwise of I-beam 157 as required to follow the lateral position of unit 11. In addition, the elevation of track 16 may be adjusted by moving sleeve 164, which encircles perforated member 160, upwardly until the desired elevation is obtained. Thereafter, a pin 165 is inserted through aligned apertures in sleeve 164 and perforated member 160. Channel 16 is carried by arm 166 attached to sleeve 164, channel 16 having its web attached to the upper portion of arm 166 by means of nut and bolt assemblies 167.

In FIGS. 17–20 a modified form of the present invention is disclosed. This modification is intended for use with tubes individually accessible or mounted, such as is usually found in furnaces or boilers rather than being mounted in a common header as is usually found in tube bundles. Furnace or boiler tubes are generally in excess of 2 inches in diameter whereas the tubes in tube bundles are usually less than 1 inch. With boiler tubes, such as 170, the frame arrangement, such as 12, shown in FIGS. 1, 5 and 6, is not needed because the rotating and reciprocating mechanism 11' may be attached directly to the tube 170. To this end, an adapter coupling 171 is suitably attached onto the end of tube 170. Thereafter, a nipple-plate member 172 has its nipple portion 173 threaded into reducer coupling 171. Plate 174 of member 172 carries a plurality of shouldered screws 175 which are received in tapped apertures therein. The shoulder portion of screws 175 are received in slots 177 of adapter plate 178 mounted at the end of supporting frame 179. In this respect, plate 178 is mounted against plate 174 by passing the heads of screws 175 through enlarged openings 180 and thereafter moving plate 178 downwardly until the shouldered shanks of screws 175 are received in slots 177.

Frame 179 carries a motor 182 which drives chain 183 which rotates a sprocket 184 fixedly attached to tube 185. In addition, motors 186 and 187 drive sprockets which in turn drive drive wheels 190 and 191. The mode of operation of the lance advancing and rotating mechanism mounted on base 179 is identical to that described above relative to unit 11 and therefore a detail description is not deemed necessary. It will be appreciated that unit 11' operates in an identical manner to unit 11 and the only difference between the two resides in the manner of mounting it relative to the tube which is to be cleaned. The end of the lance remote from tube 170 may be supported by structure identical to that shown in FIGS. 1–4.

In FIGS. 21–34 a modified form of frame structure 200 is shown mounted on end plate 21 of tube bundle 13. Frame assembly 200 is highly simplified and can be assembled and disassembled rapidly. In this respect, it can be set up for operation in less than one-half hour and can be disassembled in even less time.

Broadly, and by way of preview, the frame assembly 200 consists of frame members 201 and 202 which are clamped to end plate 21 and which mount frame members 203 and 204, respectively, for vertical reciprocatory movement. A plurality of bars, which constitute a track arrangement, are carried by frame members 203 and 204 and they in turn mount a carriage 205 which in turn mounts advancing and rotating mechanism 206 for lance 207. Mechanism 206 may be substantially identical to mechanism 11 described in detail above and therefore further description is not deemed necessary.

In more specific detail, frame members 201 and 202 (FIGS. 23 and 24) are mirror image counterparts of each other. Frame members 201 and 202 include plates 208 and 209, respectively, which have rods 210 and 211 welded thereon. Each plate 208 and 209 also carries a pair of clamp members 213 (FIGS. 22, 23 and 24) for mounting plates 208 and 209 on end plate 21 of tube bundle 13.

The clamp members 213 are attached to end plate 21 in such a manner so as to cause bars 210 and 211 to extend in a vertical direction substantially parallel to each other. In this respect, each clamp member 213 has a C-frame 214 mounting an anvil 215 and a screw member 216 which is threaded through sleeve portion 217. By rotating screw member 216 by means of handle 218, threaded member 216 is advanced until end plate 21 is clamped between anvil 215 and foot 219 at the end of screw 216. The same procedure is followed relative to each of clamp members 213, which must be oriented on the outer rim of end plate 21 in such a manner as to cause rods 210 and 211 to extend vertically.

The portion of plate 209 which is closest to the rim of end plate 21 includes apertures 220 therein (FIG. 22) for receiving the central portion of nut and bolt assembly 221 which extends through spaced coaxial sleeves 222 and 223 formed integrally on C-frame 214. A circular disc 224 is welded to the end of sleeve 222 and bears against one side of plate 209. An identical circular disc 225 is mounted for movement on bolt 221 and is tightened against plate 209 by nuts 226. Thus, plate 209 is sandwiched tightly between discs 224 and 225 to thereby hold it rigidly relative to the rim of end plate 21. Thereafter, nut 227 is tightened to further stabilize the assembly. The foregoing structure exists on each of the four clamp members 213 and it is by means of these four clamp members that plates 208 and 209 are rigidly secured to the rim of end plate 21.

Plate members 203 and 204, which are mirror image counterparts of each other, are mounted on bars 210 and 211 for vertical adjustable movement. In this respect, spaced concave rollers 229 (FIGS. 24 and 27) are rotatably mounted on each of plates 203 and 204 for engaging the rear rounded surfaces of bars 210 and 211 in complementary mating engagement. An idler pinion 230 is journalled proximate the top of each of plates 203 and 204 for engagement with the teeth of racks 231 and 232 welded to bars 210 and 211, respectively. A lower pinion 233 on each of plates 203 and 204 is also in mesh with racks 231 and 232. The lower pinion 233 (FIGS. 27, 32 and 33) forms a part of a gear box 234 which is mounted on the outside of each of plates 203 and 204, and by means of a handle 235 mounted on shaft 236, a suitable worm gear arrangement (not numbered) is actuated to drive pinion 233 which is keyed to shaft 237. Rollers 238, which are coaxial with pinions 233 and bracket the sides of each rack 231 and 232, aid in maintaining proper alignment of the pinions on the racks. By means of the foregoing arrangement, plates 203 and 204 may be moved axially of rods 210 and 211. It will be appreciated that plates 203 and 204 will be retained in the position to which they were last moved because of the inherent nature of the worm gear arrangement 34.

In order to support carriage 205 for movement across the face of end plate 21, a track arrangement consisting of upper rod 239 and a pair of lower rods 240 is mounted between plates 203 and 204. Rods 239 and 240 are mounted in an identical manner. In this respect, plate 203 carries sleeve bushings 241 and plate 204 carries sleeve bushings 242. Each of the rods 239 and 240 is slipped through a pair of coaxially aligned bushings 241–242 to occupy the positions shown in FIGS. 23 and 24. Thereafter, pins 243 are inserted through aligned apertures in sleeves 242 and their respective rods 239 and 240. It is to be noted that pins 243 are required only for bushings 242, as this will be sufficient to prevent any disassembly between the rods and plates 203 and 204 which may result from vibration.

The carriage 205 is actually assembled with rods 239 and 240 prior to the time that these rods are placed in their fully assembled position shown in FIG. 24. In this respect, while the rods 239 and 240 are being threaded through aligned bushings 241 and 242, they are also threaded through tubes 245. More specifically, the tubes 239 and 240 are inserted through bushings 241 and plate 203 and thereafter inserted through tubes 245 on carriage 205, and thereafter inserted through bushings 242 in plate 204. Thereafter, tubes 239 and 240 are rotated until the apertures therein are in alignment with the apertures in bushings 242 and thereafter pins 243 are inserted, as described above.

Each of tubes 245 is identical in structure and mounts bearings at opposite ends thereof to permit the tubes 245, and the carriage 205 supported thereby, to slide longitudinally on rods 239 and 240, which as noted above, constitute a track assembly for the carriage. For the sake of simplicity, the specific bearing structure is not shown in FIGS. 23 and 24, but is shown in FIGS. 25 and 26. In this respect, the bearing assembly at each end of each tube 245 consists of three rollers spaced 120 degrees from each other and journalled on brackets 248 formed on the outside of tube 245. Because of the foregoing roller arrangement, free movement of carriage 25 can be effected. It will be appreciated that as an alternate to the bearing arrangement consisting of rollers 247, sleeve bearings may be utilized if desired. As noted previously, the bearings on tubes 245 have been eliminated from all the drawings except FIGS. 25 and 26.

Each of tubes 245 is mounted on carriage 205 by means of a block arrangement. In this respect, carriage 205 includes a horizontal plate member 250 having block portions 251 welded to the underside thereof (FIG. 23), and carriage 205 also includes a vertical plate 252 extending vertically from plate 250 and having block portions 251 welded thereto (FIG. 28). Each of blocks 251 have a semicircular cutout for receiving the outside of each cylindrical tube 245 in complementary mating engagement. Clamping blocks 253 (FIG. 28), which also have a semicircular cutout therein, are placed in complementary mating engagement with the outsides of tubes 245 and are forced into clamping engagement with the tubes by tightening screws 254 which extend through blocks 252 and are threaded into blocks 251. It can thus be seen that carriage 205 is firmly supported for reciprocating movement across the face of end plate 21 by virtue of the foregoing construction.

The lance rotating and advancing assembly 206 is removably mounted on horizontal plate 250 of carriage 205 in a cantilevered manner. In this respect, opposite sides of plate 250 include keyways or elongated slots 256 therein. Slots 256 face each other and receive the outer side edges 257 of bottom plate 258 forming a part of lance rotating and advancing mechanism 206 (FIGS. 24 and 29). Plate 258 has a pair of spaced apertures 261, only one of which is shown in FIG. 29. A pin 260 (FIG. 29) is dropped through each aperture 261 in plate 258 and apertures 262 (FIG. 24) in carriage plate 250 to lock plate 258 to plate 250 to thereby prevent plates 250 and 258 from separating. A plurality of pilot pins 264 extend outwardly from vertical carriage plate 252 (FIGS. 24 and 28) for guiding the front portion 206' of lance advancing mechanism 206 into proper position on carriage 205 so that lance guiding tube 266 (FIG. 28) will occupy the precise desired position within aperture 267 in vertical plate 252.

An indexing arrangement is mounted on carriage 205 for aligning the lance 207 with tubes 269 in a highly efficient manner. In this respect, as can be seen from FIG. 23, the horizontal spacing X between each tube and the tube adjacent thereto is equal. As can be seen from FIGS. 24, 30 and 31, an indexing pin 270 is mounted on one side of carriage 205 and an indexing pin 271 is mounted on the other side of carriage 205. Indexing pins 270 and 271 are identical in construction except that the handles 272 and 272' extend in opposite directions.

In order to set up indexing pins 270 and 271 for use, it is only necessary to place sufficient washers 273 (FIG. 30) on bolts 274 between the side 275 of carriage 205 and the side 276 of pin 270 so that the distance Y (FIG. 24) between the centerline of lance 207 and the centerline of pin 270 is an even multiple of the distance X (FIG. 23), which is the horizontal distance between adjacent tubes 269. An analogous adjustment is made by the use of washers such as 273 relative to indexing pin 271 so that the distance Z, which is the distance between the centerline of lance 207 and the centerline of index pin 271, is an even multiple of the distance X, which is the horizontal distance between the centerlines of adjacent tubes 269. Thereafter, additional washers 273' (FIG. 31) are mounted on bolts 24 and the assembly is completed by tightening nuts 277 thereon in such a manner that indexing pin 270 can move from the dotted line position of FIG. 30 to the solid line position shown therein by virtue of the fact that slot 278, in which bolts 274 are located, will permit such movement. When indexing pin 270 is in the solid line position in FIG. 30, lance 207 must be in alignment with a tube 269 in the same horizontal row. This can be seen more readily in FIG. 24 wherein indexing pin 271, which is identical to pin 270 except for the handle, is shown inserted into one tube 269 to effect alignment between the lance 207 and another tube 269.

The reason for having indexing pins 270 and 271 on opposite sides of the carriage is so that the lance 207 can be inserted in tubes 269 on the right portion of FIG. 24 by the use of indexing pin 271, when indexing pin 270 is off to the right beyond tubes 269, and indexing pin 270 can be used to align lance 207 with the tubes 269 at the extreme left of FIG. 24 when indexing pin 271 is to the left beyond tubes 269 in FIG. 24. In other words, all that is necessary to align lance 207 with any of the tubes 269 is to merely insert the properly adjusted indexing pin 270 or 271 into a tube 269 and thereafter merely feed lance 207 through another tube 269 with which it comes into alignment. Thus, for example, to insert the lance 207 into the row of tubes shown in FIG. 24, starting from left to right, it is merely necessary, after index pins 271 and 270 have been properly aligned, to insert the tip 280 of indexing pin 270 into one of the tubes so that lance 207 will be fed into the tube 269 at the extreme left of FIG. 24. After lance 207 has been withdrawn from the extreme left of tube 269, indexing tip 280 is inserted into the tube 269 to the right of the tube 269 in which it was previously located, and this will automatically align lance 207 with the second tube 269 from the left side of FIG. 24. The foregoing procedure is followed until such time as indexing pin 270 moves beyond the last tube 269 at the right of FIG. 24. At this time indexing pin 271 will be used to align lance 207 with the required tube 269 to be cleaned, and after such tube is cleaned, indexing pin 271 is moved one tube to the right so that the lance can enter the next tube, and this sequence is repeated until such time as the last tube 269 at the right has been cleaned by lance 207.

After all tubes 269 in a horizontal row have been acted on by lance 207, either moving from right to left or left to right, as may be most convenient for the operator who merely shifts carriage 205 manually in the desired direction, as guided by the positioning of indexing pins 270 or 271, the carriage 205 is raised or lowered, as required, to align the lance with the next higher or lower row of tubes by manipulating cranks 235 associated with the gear boxes 234 which drive pinions 233 which are in mesh with racks 231 and 232. It is thus by the manipulation of cranks 235 that the elevation of the track assembly consisting of rods 239 and 240 can be adjusted. Here again, the adjustment can be effected to the proper degree by insuring that the tips of indexing pins 270 and 271 are each in proper alignment with spaced tubes in a particular horizontal row. In this respect, it will be appreciated that since distances Y and Z are each an even multiple of the horizontal spacing between adjacent tubes in a tube bundle, the distance Y plus Z must also be an even multiple and therefore both pins 270 and 271 can be inserted simultaneously in spaced tubes in a horizontal row. When both pins 270 and 271 are inserted properly into such spaced tubes 269, the carriage 205 will be level or aligned with the row of tubes.

In FIG. 34 an alternate type of C-clamp 282 is shown. This clamp includes a C-frame 283 mounting an anvil 284 for placement on one side of an end plate, such as 21, and a foot 285 mounted at the end of threaded shank 286 which extends through tapped opening 287 so that foot 285 will be moved into engagement with plate 21. A clamping plate 288, which is in the shape of a circular disc, is mounted at the end of threaded member 289 which extends through tapped opening 290. A circular disc 291 is mounted at the end of threaded member 292 which extends through tapped opening 293. Discs 288 and 291 are moved toward each other to clamp a plate, such as 208 or 209, therebetween. The clamp arrangement of FIG. 34 has the advantage of permitting slight adjustment of plates 209 or 208 in a direction axially of screws 289 or 292, as this might be required in certain installations where it is not possible with the construction shown in FIG. 22 wherein the location of anvil 215 and circular disc 224 determine the location of plate 209 relative to the tube bundle.

In another embodiment of the clamp (not shown), discs, such as 224 and 225, are both welded to C-frame 214 and plates, such as 208 and 209, are slipped therebetween in a good tight engagement. However, this embodiment does not have the advantage of permitting the plate to be tightened in position, as can be achieved with the embodiments of FIGS. 22 and 34.

While preferred embodiments of the present invention have been disclosed, it will be appreciated that it is not limited thereto but may be otherwise embodied within the scope of the following claims.

What is claimed is:

1. A lance reciprocating and rotating construction comprising frame means, means for securing said frame means relative to a tube to be cleaned, lance advancing and rotating means including motor means for advancing and rotating a lance, first mounting means for mounting said motor means on said frame means, carriage means for attachment to the end of said lance remote from said tube, swivel means on said carriage means for permitting rotation of said lance, carriage-supporting means for supporting said carriage means for movement toward and away from said tube, and second mounting means for mounting said carriage-supporting means, said motor means being located between said carriage means and said tube.

2. A construction as set forth in claim 1 including indexing means for indexing said lance advancing and rotating means relative to a tube bundle.

3. A construction as set forth in claim 2 wherein said carriage supporting means comprises track means, and wherein said second mounting means includes means for adjusting the position of said track means to correspond with the indexed position of said lance.

4. A construction as set forth in claim 2 wherein said indexing means comprises a template, and means for positioning said template relative to said tube bundle.

5. A construction as set forth in claim 1 wherein said motor means comprises first motor means for advancing said lance axially and second motor means for rotating said lance about its longitudinal axis.

6. A construction as set forth in claim 5 wherein said first and second motor means comprise fluid motors.

7. A construction as set forth in claim 6 including rotating seal means for effecting communication between a fluid pressure source and said first motor means.

8. A construction as set forth in claim 5 wherein said first mounting means comprise a first base, and wherein said lance advancing and rotating means include a second base journalled for rotation on said first base, means mounting said first motor means for rotation with said second base, means mounting said second motor means on said first base, and means coupling said second motor means to said second base for rotating said second base.

9. A construction as set forth in claim 8 including a hollow tube coupled to said second base and located between said second base and said tube-to-be-cleaned for guiding said lance to said tube-to-be-cleaned.

10. A construction as set forth in claim 1 including a high pressure fluid connection on said carriage means for providing high pressure fluid to said lance.

11. A construction as set forth in claim 10 wherein said motor means are positioned substantially adjacent said tube-to-be-cleaned.

12. A construction as set forth in claim 1 including a hollow tube between said motor means and said tube-to-be-cleaned for guiding said lance to said tube-to-be-cleaned.

13. A lance reciprocating and rotating construction comprising frame means, lance advancing and rotating means for advancing and rotating a lance, means for mounting said lance advancing and rotating means on said frame means proximate a tube to be cleaned, carriage means remote from said lance advancing and rotating means for mounting an end portion of said lance means for rotation, means for supporting said carriage means, and means for coupling the end of said lance means supported by said carriage means to a high pressure fluid source.

14. A lance reciprocating construction as set forth in claim 13 including first means for adjusting the elevation of said lance advancing and rotating means, and second means for adjusting the elevation of said carriage means.

15. A lance reciprocating construction as set forth in claim 14 wherein said means for supporting said carriage means comprises track means, and standard means for supporting said track means.

16. A lance reciprocating construction as set forth in claim 15 wherein said standard means include means for permitting said track means to move laterally to accommodate the lateral position of said lance means.

17. A lance reciprocating and rotating mechanism comprising base means, spaced wheel means on said base means for engaging a lance, first motor means for driving said wheel means to advance said lance axially, second motor means for causing said wheel means to revolve about the axis of said lance for rotating said lance, said wheel means comprising first and second wheels and said first motor means comprising a first motor for rotating said first wheel in a first direction and a second motor for rotating said second wheel in a second direction which is opposite to said first direction, means for adjustably mounting said first and second wheels for movement toward and away from each other to receive lances of different sizes, and means for resiliently biasing said first and second wheels toward each other.

18. A lance reciprocating and rotating mechanism as set forth in claim 17 wherein said base means is mounted on a hollow member having an opening therein for receiving said lance, and wherein said first and second wheels drive said lance through said opening in said hollow member.

19. A lance reciprocating and rotating construction for cleaning a tube comprising base means, lance-engaging means on said base means for engaging a lance, motor means coupled to said lance-engaging means for rotating said lance and advancing it axially, means for mounting said lance-engaging means substantially adjacent a tube which is to receive said lance, and means for indexing said lance relative to a tube bundle.

20. A lance reciprocating and rotating construction as set forth in claim 19 including means for varying the rate of rotation and the speed of axial movement of said lance.

21. A lance reciprocating and rotating construction as set forth in claim 19 wherein said lance-engaging means comprises wheel means, and lance guide means positioned between said wheel means and the entrance of said tube.

22. A lance reciprocating and rotating construction as set forth in claim 19 including a lance for engagement by said lance-engaging means, and tip means on said lance for applying resistance to movement of said lance.

23. A frame for mounting a lance advancing mechanism comprising frame means, attachment means for attaching said frame means relative to the end plate of a tube bundle, a carriage for mounting a lance advancing mechanism for advancing a lance, means on said frame means for mounting said carriage for movement transversely of said end plate, and indexing means on said carriage laterally spaced from said lance for entering an aperture associated with said tube bundle to thereby align said lance with a tube to be cleaned.

24. A frame for mounting a lance advancing mechanism as set forth in claim 23 wherein said aperture comprises a tube in said tube bundle.

25. A frame for mounting a lance advancing mechanism as set forth in claim 24 including means for adjusting the position of said indexing means on said carriage to effect alignment for different tube bundles having different spacing between the respective tubes thereof.

26. A frame for mounting a lance advancing mechanism comprising frame means, clamp means for attaching said frame means to the rim of an end plate of a tube bundle, a carriage for mounting a lance advancing mechanism, means on said frame means for mounting said carriage for movement transversely of said end plate, intermediate connecting means connecting said frame means to said clamp means, said frame means comprising first and second spaced racks, and said intermediate connecting means comprising first plate means and second plate means, said first and second plate means having first and second spaced portions, said first portions of said first and second plate means being rigidly connected to said first and second racks, respectively, and said second portions of said first and second plate means being mounted on said clamp means.

27. A frame for mounting a lance advancing mechanism as set forth in claim 26 wherein a plurality of clamp means are attached to each of said first and second plate means.

28. A frame for mounting a lance advancing mechanism comprising frame means, clamp means for attaching said frame means to the rim of an end plate of a tube bundle, a carriage for mounting a lance advancing mechanism, means on said frame means for mounting said carriage for movement transversely of said end plate, and universal connection means between said clamp means and said frame means to permit said frame means to be moved to a desired position relative to said tube bundle.

29. A lance reciprocating and rotating mechanism comprising base means, spaced wheel means on said base means for engaging a lance, first motor means for driving said wheel means to advance said lance axially, second motor means for causing said wheel means to revolve about the axis of said lance for rotating said lance, means for attaching said base means relative to a tube-to-be-cleaned, and means positioned immediately adjacent said tube-to-be-cleaned for guiding said lance into said tube.

30. A frame for mounting a lance advancing mechanism comprising frame means, clamp means for attaching said frame means to the rim of an end plate of a tube bundle, a carriage for mounting a lance advancing mechanism, means on said frame means for mounting said carriage for movement transversely of said end plate, and intermediate connecting means connecting said frame means to said clamp means, said intermediate connecting means being pivotally mounted on said clamp means.

* * * * *